United States Patent [19]

Kawahara et al.

[11] Patent Number: 4,990,004

[45] Date of Patent: Feb. 5, 1991

[54] PRINTER HAVING HEAD GAP ADJUSTING DEVICE

[75] Inventors: Yuuji Kawahara; Atsushi Murakami, both of Nagoya, Japan

[73] Assignee: Brother Kogyo Kabushiki Kaisha, Japan

[21] Appl. No.: 419,592

[22] Filed: Oct. 10, 1989

[30] Foreign Application Priority Data

| | | | |
|---|---|---|---|
| Oct. 12, 1988 | [JP] | Japan | 63-257946 |
| Oct. 12, 1988 | [JP] | Japan | 63-257947 |
| Oct. 21, 1988 | [JP] | Japan | 63-138096[U] |

[51] Int. Cl.[5] ..... B41J 11/20

[52] U.S. Cl. ..... 400/56; 400/703

[58] Field of Search ..... 400/55, 56, 57, 59, 400/703

[56] References Cited

U.S. PATENT DOCUMENTS

| | | | |
|---|---|---|---|
| 4,023,662 | 5/1977 | Perucca | 400/57 |
| 4,420,269 | 12/1983 | Acuermann et al. | 400/59 |
| 4,497,588 | 2/1985 | Volke et al. | 400/59 |
| 4,609,294 | 9/1986 | Gomoll et al. | 400/59 |
| 4,652,153 | 3/1987 | Kotsuzumi et al. | 400/57 |
| 4,657,415 | 4/1987 | Kikuchi et al. | 400/59 |
| 4,676,675 | 6/1987 | Suzuki et al. | 400/56 |
| 4,720,200 | 1/1988 | Gomoll et al. | 400/56 |
| 4,738,552 | 4/1988 | Kikuchi et al. | 400/59 |
| 4,773,773 | 9/1988 | Itoh | 400/59 |
| 4,881,835 | 11/1989 | Niikawa | 400/56 |

FOREIGN PATENT DOCUMENTS

| | | | |
|---|---|---|---|
| 0053465 | 3/1983 | Japan | 400/59 |
| 0124872 | 7/1984 | Japan | 400/59 |
| 0259477 | 12/1985 | Japan | 400/59 |
| 61-262161 | 1/1986 | Japan . | |
| 0187064 | 8/1987 | Japan | 400/56 |

OTHER PUBLICATIONS

"Forms Thickness Adjusting Device", IBM Tech. Discl. Bulletin, vol. 24, No. 11A, 4/82, p. 5429.

*Primary Examiner*—Eugene H. Eickholt

*Attorney, Agent, or Firm*—Oliff & Berridge

[57] ABSTRACT

A printer having a device for advancing and retracting a print head toward and away from a paper supporting platen, an automatic head gap adjusting device for controlling the head advancing and retracting device, to advance the print head until the print head comes into contact with a recording paper, and then retracting the print head by a predetermined distance, to thereby adjust a head gap between the paper and the print head, and an operator-controlled head gap adjusting device for manually operating said head advancing and retracting device, to thereby adjust the head gap. A mode selector is provided for selecting one of an automatic adjusting mode in which the head gap is adjusted by the automatic head gap adjusting device, and a manual adjusting mode in which the head gap is adjusted by the operator-controlled head gap adjusting device.

31 Claims, 13 Drawing Sheets

PRINTER HAVING HEAD GAP ADJUSTING DEVICE

BACKGROUND OF THE INVENTION

1. Field of the Invention

The present invention relates in general to a printing apparatus having a print head for printing on a recording medium supported by a platen, and more particularly to adjustment of a head gap between the recording medium and the print head.

2. Discussion of the Prior Art

A printing apparatus generally has a platen for supporting a recording medium, and a print head to effect printing on the recording medium. Some printers are adapted to permit adjustment in the head gap, which is a clearance between the surface of the recording medium and the print head, depending upon the thickness of the medium. In a dot matrix printer using print wires, for example, a printing pressure between the print wires and the recording medium varies with the head gap. In an ink jet printer, the transfer of an ink material to the recording medium is affected by the head gap. Thus, the amount of head gap of the printer influences the printing result or quality of printed images. Since the head gap changes with the thickness of the recording medium, it is desirable to adjust the head gap to an optimum value for highest printing quality, when the thickness of the recording medium is changed.

In the light of the above, there is proposed a printer as disclosed in laid-open Publication No. 61-262161 of unexamined Japanese Patent Application. This printer includes a print head disposed movably in a transverse direction perpendicular to the length of a platen, a head advancing and retracting device for advancing and retracting the print head in the transverse direction toward and away from the platen, and head gap adjusting means for controlling the head advancing and retracting device, to adjust the head gap between the print head and the recording medium supported by the platen. The head gap adjusting means is adapted to first advance the print head for abutting contact with the recording medium supported by the platen, and then retract the print head by a suitable distance. Since the print head is retracted from the position at which the print head abuts on the medium, the head gap adjusted by the retraction of the print head reflects the thickness of the medium. The optimum head gap or the distance of retraction of the print head may be either a fixed value, or a variable which changes depending upon the thickness of the medium. In either case, the head gap can be suitably adjusted for excellent quality of the printed images.

The conventional printer capable of adjusting the head gap has either an automatic head gap adjusting arrangement wherein the adjusting device is automatically operated, or a manual head gap adjusting arrangement wherein the adjusting device is operated by the operator of the printer. However, the conventional printer does not permit both the automatic adjustment and the manual adjustment of the head gap. The automatic adjustment of the head gap assures sufficient printing quality if the recording medium is a generally used one and the printing is not conducted under special conditions. However, the head gap established by the automatic adjustment is sometimes inadequate and is preferably re-adjusted, if the recording medium is not a paper sheet or web, or the medium is a paper sheet or web made of a special material, or if the printing condition is otherwise special. This re-adjustment should be made by the operator, by using an operator-controlled adjusting device. Conventionally, however, the printer capable of automatically adjusting the head gap is not provided with operator-controlled means for permitting the operator to manually adjust the head gap or change the automatically established head gap.

Another problem experienced in the printer as disclosed in the above-identified publication is derived from the use of a stepping motor as a drive source for activating the head gap advancing and retracting device. The stepping motor is stepped in the forward direction to advance the print head toward the platen. After the print head is brought into abutting contact with the recording medium, the stepping motor is forcibly stopped even while stepping pulses are applied to the motor. Thus, the stepping motor undergoes an out-of-synchronization phenomenon upon abutment of the print head against the recording medium. This out-of-synchronization of the stepping motor is used to detect the abutting contact between the print head and the recording medium, and to reverse the operating direction of the motor, for retracting the print head away from the medium. Therefore, the printer suffers from vibrations and noises due to the abutment of the print head against the platen (medium) and resulting out-of-synchronization operation of the stepping motor.

The out-of-synchronization of the stepping motor used as the drive source of the head advancing and retracting device may be avoided by using a frictionally coupling clutch, which is adapted to transmit a drive force of the motor to the print head during movements of the print head, and undergo a slipping action upon abutment of the print head against the platen, thereby inhibiting the transmission of the drive force exceeding a preset upper limit. Since the clutch is brought to its disconnected state upon abutment of the print head against the platen, the stepping motor is protected against the out-of-synchronization phenomenon. However, the amount of operation of the stepping motor to bring the print head into abutment against the platen is set to be large enough to cause the clutch to be disconnected only after the print head has come into abutting contact with the platen, irrespective of a fluctuation in the initial position of the print head from which the print head is advanced for abutment against the platen. This arrangement inevitably suffers from a relatively long time of slipping of the clutch due to the continuing operation of the stepping motor after the print head has been stopped by the platen. Therefore, the life expectancy of the clutch tends to be shortened due to rapid wearing of the clutch.

An example of the conventional head advancing and retracting device is partly illustrated in FIGS. 16 and 17, in which reference numeral 101 designates a guide shaft for supporting a carriage 106 so that the carriage 106 carrying a print head 105 mounted thereon is slidably moved on the guide shaft 101 in the longitudinal direction of the guide shaft parallel to a platen 107. The guide shaft 101 is provided at its opposite ends with integrally formed eccentric support pins 102. The axes 04 of the eccentric support pins 102 are offset from the axis 03 of the guide shaft 101 by a radial distance $\Delta l$. The guide shaft 101 is rotatably supported at the eccentric support pins 102, by respective bearings 103 fixed to side walls 104 of the printer. The carriage 106 has a bearing metal 108 which is fitted on the outer circumferential surface of the guide shaft 101, so that the carriage 106 slides on the guide shaft 101, for reciprocating movements of the print head 105 parallel to the platen 107 when printing is effected on a recording medium supported by the platen 107.

When the eccentric support pins 102 are rotated by a suitable drive source such as a stepping motor as indicated above, the guide shaft 101 is rotated eccentrically with respect to the support pins 102, whereby the guide shaft 101 is displaced in the transverse direction, toward and away from the platen 107, over a range corresponding to the offset distance Δl. Thus, the power transmission mechanism illustrated in FIGS. 16 and 17 constitutes a part of the head advancing and retracting device for detecting the thickness of the recording medium and adjusting the head gap.

However, the outer sliding surface of the guide shaft 101 is exposed, and a foreign matter such as paper particles or dust may be deposited on the exposed sliding surface of the shaft 101, and may stick to the inner bearing surface of the bearing metal 108 of the carriage 106, while the carriage is reciprocating during a printing operation. Consequently, the friction force between the bearing metal 108 and the sliding surface of the guide shaft 101 tends to vary during use of the printer. More specifically, the foreign matter sticking to the bearing metal 108 increases the friction force, thereby increasing a resistance of the metal 108 to the rotation of the guide shaft 101 when the guide shaft 101 is rotated relative to the carriage 106 for detecting the thickness of the recording medium and adjusting the head gap. The increase in the above rotational resistance of the bearing metal 108 results in an accordingly increased force of abutting contact of the print head 105 with the platen 107 (recording medium). This fluctuation of the abutting force of the print head 105 with respect to the platen 107 adversely affects the accuracy of detection of the medium thickness and the accuracy of adjustment of the head gap.

SUMMARY OF THE INVENTION

It is therefore a first object of the present invention to provide a printing apparatus which permits both automatic and manual adjustments of the head gap.

A second object of the present invention is to provide a printing apparatus wherein the head advancing and retracting device for adjustment of the head gap incorporates a clutch mechanism such as a friction clutch for inhibiting a drive force of the drive source of the device exceeding a present upper limit from being transmitted to the print head, and the drive source is turned off when the clutch mechanism is released or brought to its disconnecting state.

A third object of the present invention which assures a constant force of abutting contact of the print head and the platen when the print head abuts on the platen during an adjustment of the head gap by the head advancing and retracting device in which the carriage carrying the print head is slidably supported by a support shaft.

The first object may be achieved according to one aspect of the present invention, which provides a printing apparatus comprising a platen for supporting a recording medium, a print head disposed movably in a transverse direction toward and away from the platen, a head advancing and retracting device for moving the print head in the transverse direction, automatic head gap adjusting means, operator-controlled head gap adjusting means, and adjusting mode selecting means for selecting an automatic adjusting mode or a manual adjusting mode. The automatic head gap adjusting means is operable in the automatic adjusting mode, for controlling the head advancing and retracting device until the print head comes into contact with the recording medium, and then retracting the print head by a predetermined distance, to thereby adjust a head gap between the recording medium and the print head. The operator-controlled head gap adjusting means is operable in the manual adjusting mode, for manually operating the head advancing and retracting device, to thereby adjust the head gap. The predetermined distance of retracting of the print head indicated above may be a fixed value, or may be changed depending upon the thickness of the recording medium.

In the printing apparatus of the present invention constructed as described above, the operator selects the automatic adjusting mode, when the operator wishes to effect an automatic head gap adjustment. In this mode, the automatic head gap adjusting means is operated to control the head advancing and retracting means. When the operator wishes to manually adjust the head gap, the manual adjusting mode is selected. In the manual mode, the head gap can be adjusted to a desired value by using the operator-controlled head gap adjusting means.

Thus, the present printing apparatus is capable of adjusting the head gap, in the selected one of the automatic and manual modes. In the automatic mode, the head gap is adjusted to a predetermined value which is either constant or changes with the thickness of the recording medium. In the manual mode, the head gap can be adjusted to any desired value, which is suitable for the particular recording medium such as a medium not made of a paper material, or which suits the particular printing condition. Accordingly, the printing apparatus assures high quality of printed images, under various printing conditions.

The second object may be achieved according to another aspect of the present invention, which provides a printing apparatus comprising a platen for supporting a recording medium, a print head disposed movably in a transverse direction toward and away from the platen, a head advancing and retracting device for moving the print head in the transverse direction, and automatic head gap adjusting means for controlling the head advancing and retracting device to advance the print head until the print head comes into contact with the recording medium and then retracting the print head by a predetermined distance to adjust a head gap between the recording medium and the print head. The head advancing and retracting device comprises a drive source, a power transmission mechanism for transmitting a drive force of the drive source to the print head to move the print head in the transverse direction, and a clutch mechanism which has a connecting state for transmitting the drive force of the drive source smaller than a preset value in a forward direction to advance the print head toward the platen, and disconnecting state for inhibiting the transmission of the drive force exceeding the preset value to the print head. The automatic head gap adjusting means comprises clutch release detecting means for detecting the disconnecting state of the clutch mechanism, and stopping means for stopping an operation of the drive source that produces the drive force in the forward direction, when the disconnecting state of the clutch mechanism is detected by the clutch release detecting means.

In the printing apparatus constructed as described above, the clutch mechanism is brought into its disconnecting state when the print head advancing toward the platen is stopped by abutting contact with the recording medium supported by the platen. In the disconnecting state, the drive force of the drive source exceeding the present value is inhibited from being transmitted to the print head. The disconnecting state of the clutch mechanism is detected by the clutch release detecting means, and the operation of the drive source to advance the print head is stopped based on the detecting of the disconnecting state of the clutch mechanism. In response to the detection of the disconnection of the clutch mechanism upon abutting contact of the print head against the recording medium, the head advancing and retracting device is operated to retract the print head by the predetermined distance, so as to establish a suitable head gap.

Since the operation of the drive source to advance the print head is terminated upon disconnection or release of the clutch mechanism, the clutch mechanism need not be held in its disconnecting state for an unnecessarily long time after the print head is brought into contact with the platen or recording medium. This arrangement improves the life expectancy of the clutch mechanism, reducing the amount of slip if the clutch mechanism is a friction clutch, for example. The relatively short time of the disconnecting state of the clutch mechanism makes it possible to utilize an elastic member for the clutch, so that the clutch inhibits the transmission of the drive force exceeding the preset value, due to deflection of the elastic member by the drive force. This spring-biased clutch mechanism using the elastic member is more accurate than a friction clutch, in terms of the upper limit of the drive force at which the clutch is released or placed in the disconnecting state. In the present printer wherein the drive source is turned off shortly after the abutting contact of the print head with the platen or recording medium, the energy required and the noise produced during the head gap adjustment can be favorably reduced.

In the present printing apparatus, the head gap may be adjusted in the following manner, for example:

Initially, the print head is positioned at a predetermined position which is spaced from the platen by a known distance. Then, the automatic head gap adjusting means is activated to advance the print head until the print head comes into contact with the platen, without a recording medium placed on the platen, and a first advancing distance of the print head between the predetermined position indicated above and the position at which the print head contact the platen is determined. This first advancing distance usually differs from the known distance, due to some factors such as the amount of deflection of the platen upon abutment of the print head against the platen, and the amount of clearance or play existing in the support structures for the platen and print head, for example. The difference is calculated as a specific value inherent to the particular printing apparatus. Then, the print head is retracted, and the recording medium is placed on the platen. Subsequently, the automatic head gap adjusting means is again operated, to advance the print head until the print head comes into contact with the recording medium placed on the platen, and the print head is finally retracted by a distance equal to the sum of the above-indicated specific value and a nominal head gap value. The nominal head gap value may be a predetermined fixed value, or a variable which varies depending upon the thickness of the recording medium.

The spring-biased clutch mechanism indicated above may be constructed so as to include a drive member, a driven member, a pin secured to one of the drive and driven members, so as to extend parallel to axes of rotation of the drive and driven members, and an elastic member having a predetermined pre-load. The other of the drive and driven members has a recess formed therein so that the pin engages the recess with a play in a rotating direction of the above-indicated other of the drive and driven members. The elastic member biases the pin against one of opposite ends of the recess in the above-indicated rotation direction, so that a movement of the drive member in one direction is transmitted to the driven member through engagement between the pin and the recess, while a movement of the drive member in the other direction is transmitted to the driven member through the elastic member.

The third object of the invention may be attained according to a further aspect of the invention, which provides a printing apparatus having a head supporting device for supporting a print head movably in a longitudinal direction of a medium supporting platen and in a transverse direction perpendicular to the longitudinal direction of the platen, wherein the head supporting device comprises an eccentric support shaft disposed parallel to the platen and rotatably supported by a frame of the printer, a hollow guide sleeve which is disposed radially outwardly of and coaxially with an intermediate portion of the support shaft, and a carriage which supports the print head and which is supported by the hollow guide sleeve slidably in the longitudinal direction of the platen. The eccentric support shaft has opposite end portions which are eccentric with the intermediate portion and therefore eccentric with the hollow guide sleeve. The intermediate portion of the eccentric support shaft is rotatable relative to the hollow guide sleeve on which the carriage carrying the print head is slidably mounted.

In the present printing apparatus, the carriage and the print head are moved for printing, in the longitudinal direction of the platen, while being slidably supported by the hollow guide sleeve. When the head gap is adjusted, the eccentric support shaft is rotated by a suitable drive source, whereby the intermediate portion of the eccentric support shaft is displaced in the transverse direction of the platen. Since the intermediate portion of the eccentric shaft is rotatable relative to the hollow guide sleeve, the hollow guide sleeve and the carriage are also displaced in the same direction as the intermediate portion of the eccentric support shaft, without rotation of the hollow guide sleeve and the carriage relative to the platen. Thus, the rotation of the eccentric support shaft provides a movement of the carriage and the print head as a unit, in the transverse direction of the platen, by an amount corresponding to an angle of rotation of the eccentric support shaft. This head supporting device can be used as part of the head advancing and retracting device for adjusting the head gap.

While the carriage is slidable on the hollow guide sleeve, the hollow guide sleeve is not rotated relative to the carriage, but the intermediate portion of the eccentric support shaft is rotated relative to the hollow guide sleeve. Therefore, the carriage and print head are rotated with the hollow guide sleeve as a unit, when the eccentric support shaft is rotated while being supported at its opposite end portions eccentric with the intermediate portion. In this arrangement, the force by which the print head is forced against the platen (or recording medium) upon abutting contact therebetween is not affected by a foreign matter which may exist between the slidably engaging surfaces of the carriage and the hollow guide sleeve.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
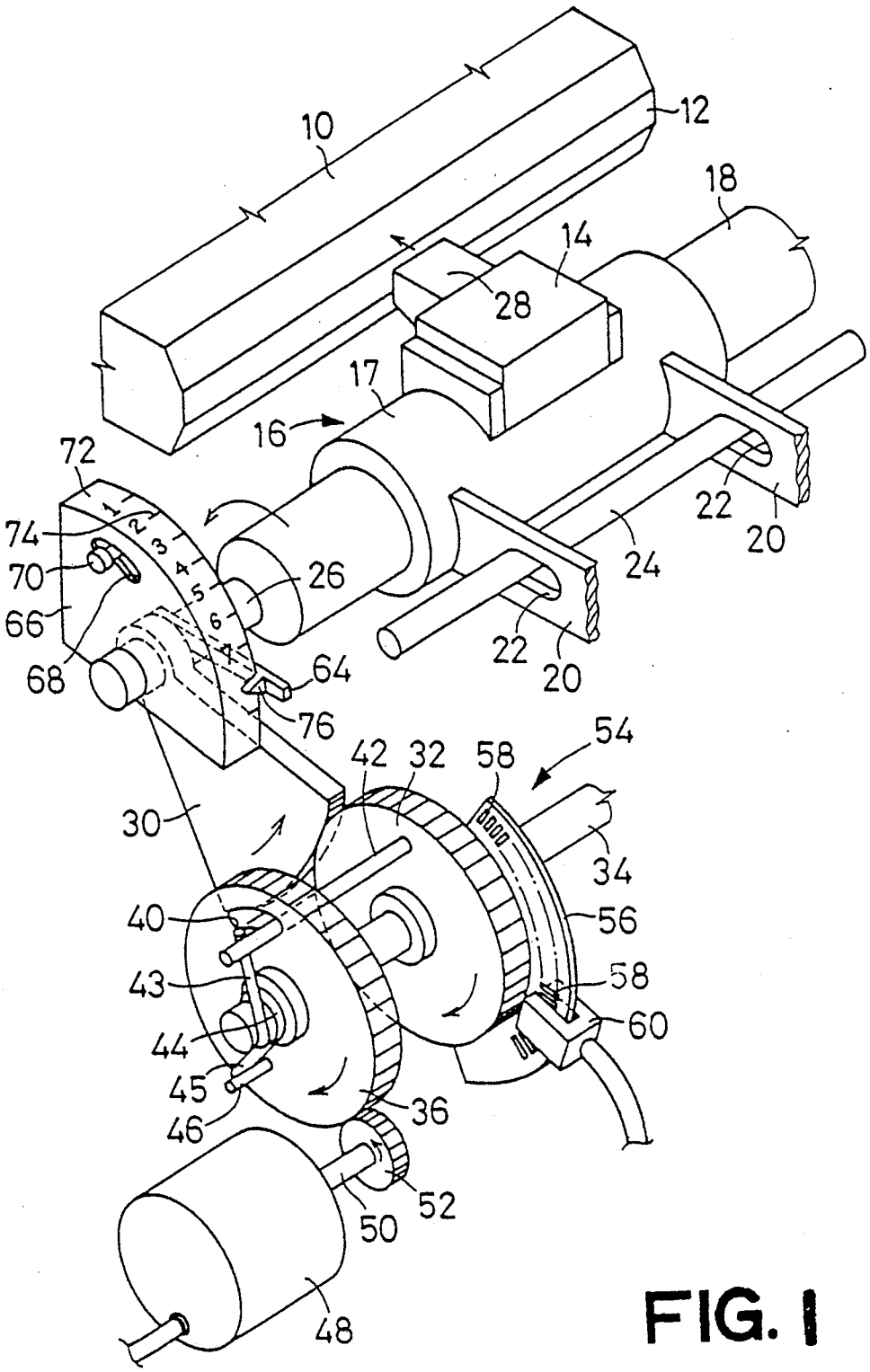
FIG. 1 is a fragmentary perspective view of a dot matrix printer according to one embodiment of the present invention.

Referring first to FIG. 1 showing a dot matrix printer, reference numeral 10 denotes a platen which has a generally rectangular shape in transverse cross section. The platen 10 is supported at the opposite ends by a frame of the printer, and has an elongate vertical bearing surface 12, which extends in the longitudinal direction of the platen 10, for supporting a recording medium such as a cut sheet or web. A print head 14 is disposed in facing relation with the bearing surface 12 of the platen. The print head 14 is mounted on a carriage 16, which has an integrally formed hollow cylindrical slide 17 slidably engaging a support shaft 18 parallel to the platen 10. The slide 17 and the support shaft 18 are rotatable as a unit by are axially movable relative to each other.

The hollow cylindrical slide 17 is formed with a pair of spaced-apart arms 20 extending away from the platen 10. Each of the arms 20 has an elongate hole 22 formed therethrough, so as to extend in the transverse direction of the platen 10. A stationary guide bar 24 extends parallel to the platen 10, through the elongate holes 22 of the arms 20. The support shaft 18 has opposite eccentric end portions 26, 26 which are rotatably supported by the printer frame.

The print head 14 is of a dot matrix type having a suitable number of print wires which extend through a nose 28. While the carriage 16 carrying the print head 14 is moved along the platen 10, the print wires are selectively operated to print dots on the recording medium, by energization of appropriate solenoids as well known in the art. Thus, the printer effects a printing operation.

The axes of rotation of the eccentric end portions 26 are eccentric with respect to the axis of the intermediate portion of the support shaft 18. One of the eccentric end portions 26 is provided with a sector gear 30 secured thereto. The sector gear 30 meshes with a first spur gear 32, which acts as a driven gear of a clutch mechanism 53 (which will be described). The first gear 32 is mounted on a shaft 34 disposed in parallel with the eccentric end portion 26, such that the first gear 32 and the shaft 34 are rotated as a unit. The shaft 34 also supports a second gear 36 such that the second gear 36 is rotatable relative to the shaft 34. The second gear 36 acts as a drive gear of the clutch mechanism 53.

The second gear 36 has an arcuate hole 40 formed through its width along an arc of a circle, whose center lies on the axis of rotation of the gear 36. The first gear 32 has a connecting rod or pin 42 secured thereto so as to extend parallel to the shaft 34, such that the pin 42 is spaced from the axis of the gear 32. The pin 42 extends through the arcuate hole 40, such that the free end portion of the pin 42 projects a certain distance from the surface of the second gear 36. The arcuate hole 40 has a length determined to provide a sufficient play between the hole 40 and the pin 42, in the rotating direction of the second gear 36. A spring 44 is wound round the shaft 34, such that one arm 43 of the spring 44 is held in abutting contact with the free end portion of the pin 42. The other arm 45 of the spring 44 is held in abutting contact with a pin 46 secured to the second gear 36. The spring 44 functions to bias the pin 42 against one of the opposite ends of the arcuate hole 40.

The second gear 36 meshes with a pinion 52 fixedly mounted on an output shaft 50 of a drive source in the form of a stepping motor 48. When the second gear 36 is rotated in the clockwise direction as seen in FIG. 1 by the stepping motor 48, the first gear 32 is rotated with the second gear 36 in the same direction, such that the connecting rod or pin 42 is kept in abutting contact with the end of the arcuate hole 40 under the biasing action of the spring 44. As a result, the sector gear 30 is rotated, and the eccentric end portions 26 are rotated about their axes, whereby the print head 14 on the carriage 16 is advanced toward the platen 10. When the print head 14 comes into abutting contact with the bearing surface 12 of the platen 10 or the recording medium on the platen, the advancing movement of the print head 14 is stopped, whereby the rotations of the sector gear 30 and first gear 32 are stopped, whereby the connecting rod or pin 42 does not follow the rotation of the second gear 36, and only the second gear 36 is rotated, so that the rotary motion of the stepping motor 48 is not transmitted to the first gear 32 and print head 14. Thus, it will be understood that the second gear 36 having the arcuate hole 40, the first gear 32 having the connecting pin 42, and the spring 44 constitute a torque limiter 53, i.e., the clutch mechanism indicated above. The torque limiter or clutch mechanism 53 functions to transmit a drive force of the motor 48 in the forward direction (clockwise rotation of the second gear 36) to the print head 14 to advance the print head, until the print head abuts on the platen 14 or recording medium. Since the clutch mechanism 53 allows the stepping motor 48 to continue to rotate a certain angle even after the print head 14 is brought into abutting contact with the platen 14, the clutch mechanism protects the motor 48 from an out-of-synchronization phenomenon, i.e., prevention of stepping actions due to mechanical blocking upon abutment of the print head against the platen 14. The continuing rotation of the motor 48 will cause elastic deformation of the spring 44 by the resulting rotation of the second gear 36, which provides a force for pushing the print head 14 against the platen 10. As described later, the stepping motor 48 is turned of a suitable time after the print head 14 is brought into abutting contact with the platen 10.

When the second gear 36 is rotated in the counterclockwise direction as seen in FIG. 1, the connecting rod or pin 42 is pushed by the end of the arcuate hole 40, and the first gear 32 is also rotated in the same direction, whereby the print head 14 is retracted away from the platen 10. In the present embodiment, the hollow cylindrical slide 17, support shaft 18, sector gear 30, clutch mechanism 53 and stepping motor 48 constitute a principal part of a head advancing and retracting device. The stepping motor 48 is a 4-phase stepping motor which is stepped in a 2-2 phase excitation fashion by simultaneous excitation of two stator poles. The stepping pulse voltage applied to the motor 48 to move the print head 14 is 39 V while the hold voltage applied to hold the print head 14 is 5 V. Accordingly, the drive force to move the print head 14 is considerably larger than the force to hold the print head. The amount of a pre-load applied to the spring 44 to bias the pin 42 is selected to be intermediate between the drive force and the hold force produced by the motor 48.

The first gear 32 is provided with a position sensor in the form of a rotary encoder 54, for detecting a movement of the print head 14 in the transverse direction of the platen 10. The encoder 54 includes a movable slit member in the form of a sector plate 56 secured to one of opposite sides of the first gear 32 remote from the second gear 36. The sector plate 56 has an arcuate slit portion having a multiplicity of equally spaced slits 58, and an arcuate non-slit portion extending from one end of the slit portion. The encoder 54 further includes a photo-interrupter 60 having a bifurcated structure. The photo-interrupter 60 is disposed such that the two sides of the bifurcated structure face the opposite surfaces of the peripheral part of the sector plate 56 which includes the slit and non-slit portions. The photo-interrupter 60 includes a stationary basic slit member and a stationary direction slit member. For each of these two stationary slit members, a light-emitting element and a light-receiving element are provided to generate a basic pulse signal and a direction pulse signal. The light-emitting and light-receiving elements for each stationary slit member are disposed such that the peripheral portion of the movable slit member or sector plate 56 and the corresponding stationary slit member are located between the light-emitting and light-receiving elements, so that a light beam emitted by the light-emitting element and transmitted through the slits of the movable and stationary slit members is received by the light-receiving element. A movement of the print head 14 and the direction of the movement are determined based on changes in the levels of the basic and direction pulse signals produced as the outputs of the two light-receiving elements. The number of the slits 58 is large enough to cover an advancing and retracting stroke of the print head 14.

The sector gear 30 has a lever 64 secured thereto, and a scale plate 66 is supported by the printer frame such that the scale plate 66 is adjacent to the sector plate 30. The scale plate 66 engages the end of the eccentric end portion 26 which projects outwardly of the frame, such that the scale plate 66 and the eccentric shaft 26 are rotatable relative to each other. The scale plate 66 has an arcuate hole 68 formed therethrough along an arc of a circle whose center lies on the axis of the eccentric end portion 26. The scale plate 66 is secured to the frame by a fixing bolt 70 which extends through the arcuate hole 68 for screwing in the frame. Thus, the position of the scale plate 66 is adjustable by loosening the fixing bolt 70.

The scale plate 66 has an arcuate calibrated surface 72 whose center lies on the axis of rotation of the eccentric end portion 26 of the support shaft 18. The calibrated surface 72 has a plurality of equally spaced graduations 74 (numbered division line). On the other hand, the lever 64 has a pointer 76 formed on a surface thereof which faces the scale plate 66. When the eccentric end portion 26 of the support shaft 18 is rotated, the lever 64 is pivoted with the pointer 76 moving along the calibrated surface 72. The position of the print head 14 relative to the platen 10 is indicated by the pointer 76 positioned on the calibrated surface 72 with the graduations 74.

The lever 64 may be used by the user of the printer, to manually adjust the head gap by advancing or retracting the print head 14, while the stepping motor 48 is energized by the hold voltage of 5 V. In this case, the stepping motor 48 is rotated by the second gear 36 which is rotated with the first gear 32 when the first gear 32 is rotated by the lever 64, since the pre-load of the spring 44 of the clutch mechanism 53 is larger than the hold force of the motor 48 produced by the hold voltage of 5 V. Thus, the print head 14 may be moved by the lever 64 to a desired position corresponding to the position of the lever 64. The print head 14 is maintained at that position by the hold force of the motor 48.

The interval between the adjacent graduations 74 or division lines on the calibrated surface 72 of the scale plate 66 is four times a distance of movement of the pointer 76 (pivotal movement of the lever 64) which is provided by application of one stepping pulse to the stepping motor 48.

Figures 2, 3:
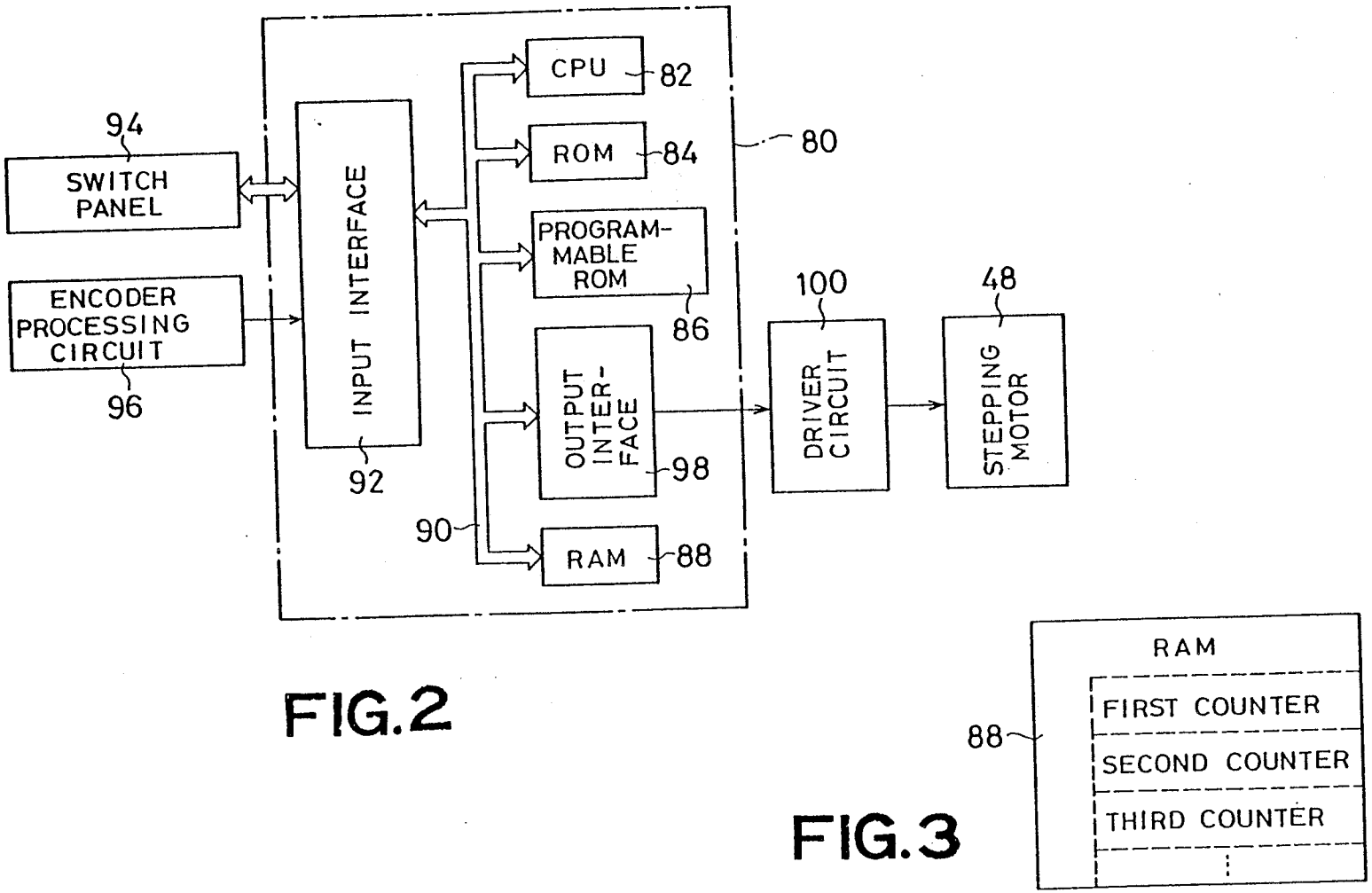
FIG. 2 is a schematic block diagram showing a control system of the printer.
FIG. 3 is a view illustrating a random-access memory of a computer which constitutes a major portion of the control system.

Referring next to FIG. 2, the present printer is controlled by a control device indicated generally at 80 in the figure. The control device 80 principally consists of a microcomputer which incorporates a CPU 82 (central processing unit), a ROM 84 (read-only memory), a programmable ROM 86 ($E^2$ PROM), a RAM 88 (random-access memory), and a bus 90 for interconnecting these components.

To the bus 90, there is connected an input interface 92 which in turn is connected to a switch panel 94 and an encoder processing circuit 96. The switch panel 94 has alpha-numeric keys for entering data (e.g., data indicative of the number of the graduations 74 when adjusting the head gap depending upon the thickness of the recording medium), motor on/off switches for controlling motors such as the stepping motor 48, selector switches such as a switch for selecting a head gap adjusting mode, and other switches. The encoder processing circuit 96 is adapted to process the signals generated by the encoder 54.

The bus 90 is also connected to an output interface 98, to which is connected a driver circuit 100 for driving the stepping motor 48. The RAM 88 of the control device 80 includes a first counter, a second counter and a third counter, as illustrated in FIG. 3, as well as a working memory. The functions of these counters will become apparent from the following description. The $E^2$ PROM 86 is an erasable programmable read-only memory which is not cleared upon power removal from the printer, and in which stored data can be erased and reprogrammed. The ROM 84 stores various data necessary for the printer, which includes: a formula for calculating the number of stepping pulses of the stepping motor 48 representative of an optimum head gap for each specific thickness of the recording medium (which is also represented by the number of stepping pulses); and a data table representative of a relationship between the number of the individual graduations 74, and the positions Mn of the print head 14 corresponding to the graduations 74. The positions Mn are represented by the number of stepping pulses of the stepping motor 48 necessary to move the print head 14 from the initial position which is established when the pointer 76 is aligned with each graduation 74, as described below in detail.

Figure 4:
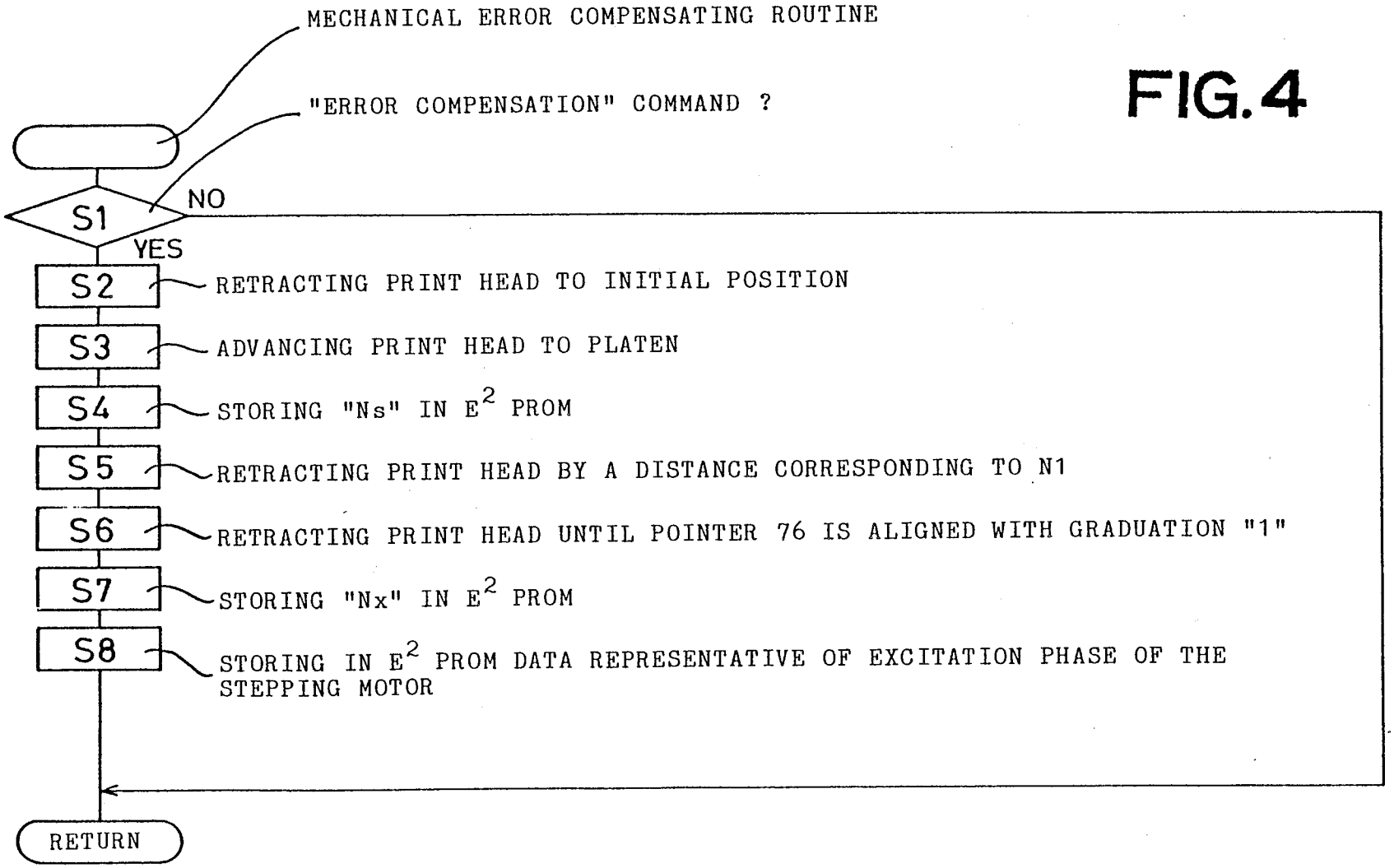
FIG. 4 is a flow chart illustrating a mechanical error compensating routine stored in a read-only memory of the computer.
Figure 5:
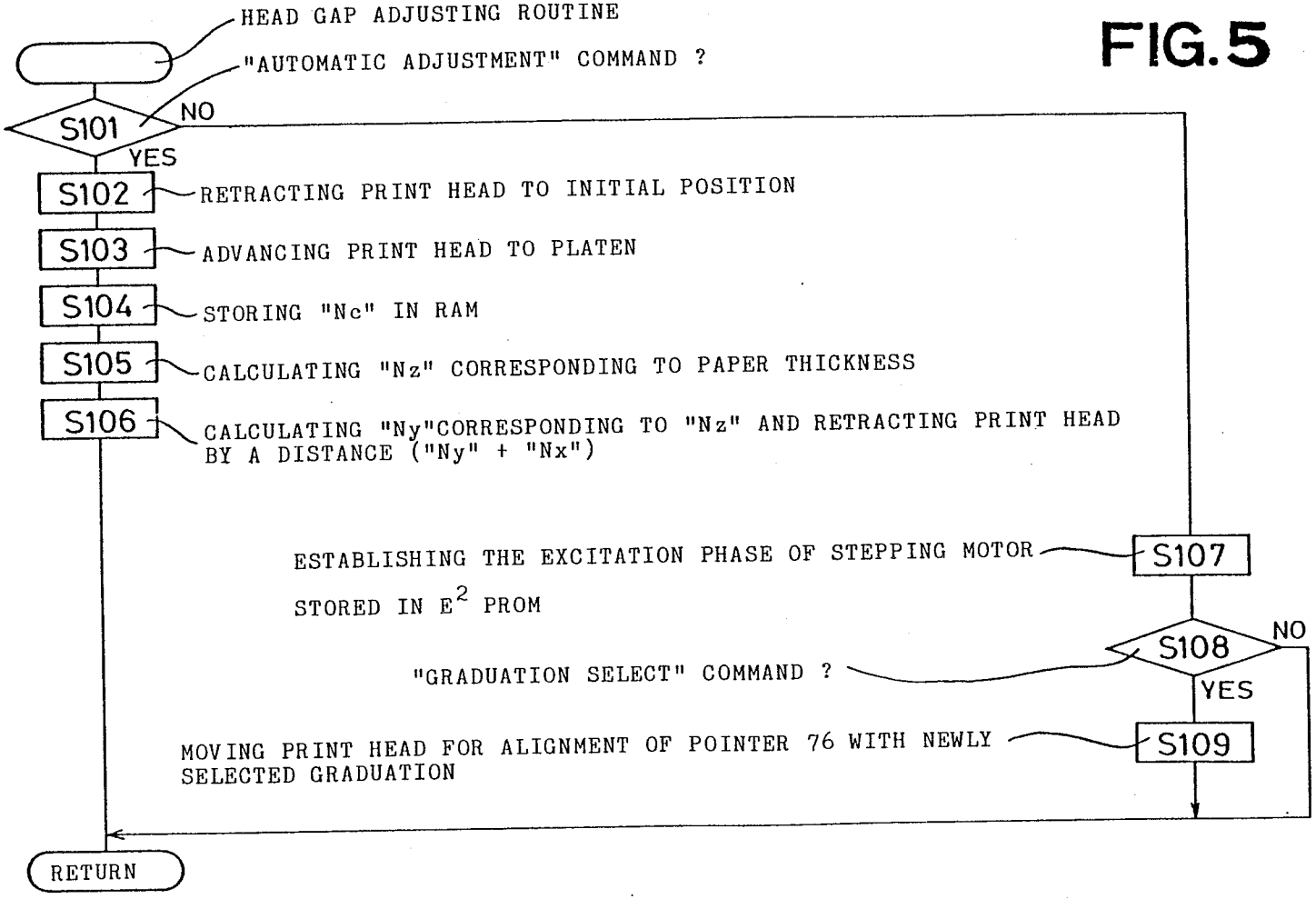
FIG. 5 is a flow chart illustrating a head gap adjusting routine also stored in the read-only memory.

The ROM 84 further stores a program for executing a mechanical error compensating routine illustrated in the flow chart of FIG. 4, and a program for executing a head gap adjusting routine illustrated in the flow chart of FIG. 5. These compensating and adjusting routines will be described by reference to FIGS. 4 and 5.

The compensation for a mechanical error of the apparatus which affects the head gap is first effected manually during assembling of the printer. This manual mechanical error compensating procedure is effected while no stepping voltage is applied to the stepping motor 48. In this connection, it is noted that the motor 48 is of a PM type (permanent magnet type). This PM type of stepping motor is maintained in a stable position due to a detent force produced by a magnetic force between rotor teeth and appropriate stator pole teeth which face each other, even while the stepping motor 48 is not energized. Therefore, a movement of the print head 14 by the lever 64 takes place with a rotating movement of the motor 48 against the detent force.

Figure 6:
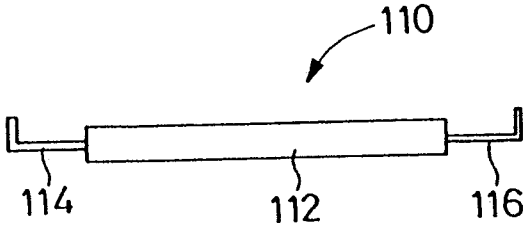
FIG. 6 is a plan view showing a thickness gauge used in manually compensating for a mechanical error in connection with a head gap of the printer.
Figure 8:
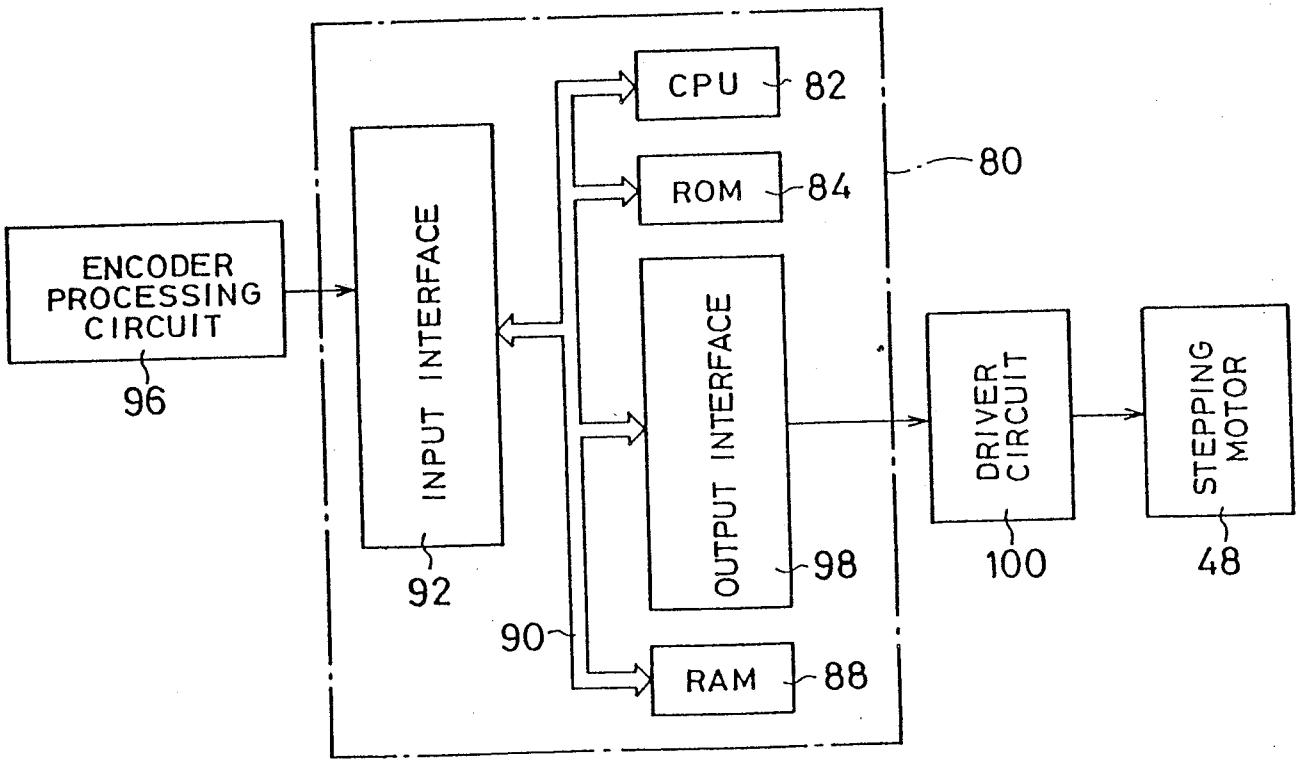
FIG. 8 is a schematic block diagram showing a control system of the printer of FIG. 7.

A thickness gauge 75 as illustrated in FIG. 6 is used for the manual adjustment of the head gap to compensate for the mechanical error of the printer. The thickness gauge 75 has a gripping portion 77, and two gauge elements 78, 79 provided at the opposite ends of the gripping portion 77. The gauge elements 78, 79 consist of L-shaped wires having different diameters. More specifically, the gauge element 78 is a "no-go" element having a larger diameter than the gauge element 79, which is a "go" element. The difference between the diameters of the "no-go" and "go" elements 78, 79 is a tolerance of the initial head gap between the print head 14 and the platen 10.

Initially, the print head 14 is advanced toward the platen 10, by operating the lever 64. When the print head 14 considerably approaches the platen 10, the thickness gauge 75 is positioned adjacent to the bearing surface 12, such that the gripping portion 77 is perpendicular to the longitudinal direction of the platen 10 and is parallel the bearing surface 12. The position of the print head 14 is adjusted so that the "go" element 79 can be inserted into the gap between the platen 10 and the print head 14, but the "no-go" element 78 cannot be inserted into the gap. In this position, however, the stepping motor 46 should be placed in a stable position maintained by the detent force indicated above. In this condition, the fixing bolt 70 is loosened, and the scale plate 66 is rotated so that the pointer 76 of the lever 64 is aligned with the graduation 74 numbered "1" on the calibrated surface 72. Then, the bolt 70 is tightened to fix the scale plate 66 to the printer frame.

The above manual adjustment is conducted without the print head 14 abutting on the platen 10. In an automatic mode of adjustment of the head gap, however, the print head 14 is automatically advanced for abutting contact with the platen 10. In this automatic adjustment, therefore, an advancing movement of the print head 14 includes an error movement which is caused by elastic deformation of the platen 10, backlashes, plays or fluctuating clearances of the support structures for the platen 10, print head 14 and other components. The amount of this error movement varies depending upon the specific printer. This error amount is reflected as a deviation of the pointer 76 from the graduation 74 numbered "1", even if the print head 14 is retracted from the position of abutment on the platen 10, by the distance equal to the initial head gap determined by the use of the thickness gauge 75 as described above. To compensate for the above error movement of the print head 14 due to the mechanical error caused as by the elastic deformation of the platen 10, a re-adjustment of the head gap is manually effected according to the flow chart of FIG. 4. This manual re-adjustment eliminates a deviation of the pointer 76 from the graduation 74 numbered "1".

The mechanical error compensating routine of FIG. 4 begins with step S1 to determine whether an ERROR COMPENSATION command to effect the present compensating routine is present or not. This command is entered through the switch panel 94. If the command is present, an affirmative decision (YES) is obtained in step S1, and the control flow goes to step S2 in which the print head 14 is moved to its initial position. This initial position is established by first retracting the print head 14 until the non-slit portion of the movable slit member 56 (sector plate) without the slits 58 is moved past the photo-interrupter 60, and then advancing the print head 14 by reversing the direction of operation of the stepping motor 48. After the first slit 58 of the movable slit member 56 is detected during the advancing movement of the print head, the motor 48 is further operated by a suitable number of steps (e.g., seven steps) and then turned off. Thus, the initial position of the print head 14 or motor 48 is established.

Step S2 is followed by step S3 in which the print head 14 is advanced until it comes into abutting contact with the platen 10, without the thickness gauge 76 placed between the print head and the platen. With the print head 14 abutting on the platen 10, the output signals of the encoder 54 remain unchanged. In response to the permanency of the output level of the encoder 54, the stepping motor 48 is turned off. While the stepping motor 48 is operated in the forward direction to advance the print head 14 from the initial position to the position of abutment of the print head 14 on the platen 10, the number Ns of stepping pulses applied to the motor 48 is counted by the first counter of the RAM 88. In the next step S4, the counted number Ns (hereinafter referred to as "advancing pulse number Ns") is stored in the $E^2$ PROM 86.

Then, the control flow goes to step S5 in which the stepping motor 48 is operated in the reverse direction by a predetermined number N1 of pulses, whereby the print head 14 is retracted away from the platen 10 by a distance corresponding to the number N1. The number N1 representing the retracting distance corresponds to the initial head gap which is intermediate between the diameters of the "no-go" element 78 and "go" element 79 of the thickness gauge 75. Therefore, the pointer 76 deviates from the No. "1" graduation 74 after the print head 14 is retracted by the retracting distance represented by the number N1 of stepping pulses. To eliminate this deviation or to align the pointer 76 with the No. "1" graduation 74, step S6 is executed to permit the operator of the printer to operate the stepping motor 48 until the pointer 76 comes into alignment with the No. 1 graduation 74. This is achieved by operating the appropriate motor stepping switch on the switch panel 94, to produce a stepping pulse per operation of the switch. The number Nx of stepping pulses produced by operating the motor stepping switch on the panel 94 is counted by the second counter of the RAM 88. This number Nx represents a compensating amount corresponding to the additional retracting distance of the print head 14 so as to compensate the head gap for the mechanical error indicated above.

When a suitable switch on the panel 94 is operated after the pointer 76 is aligned with the No. 1 graduation 74, the control flow goes to step S7 in which the counted compensation number Nx (hereinafter referred to as "compensating pulse number Nx") is stored in the $E^2$ PROM 86, as the error amount or compensating retracting distance which is inherent to the relevant printer. Step S7 is followed by step S8 in which the data representative of the excitation phase of the motor 48 when the pointer 76 is aligned with the No. 1 graduation 74 is stored in the $E^2$ PROM 86.

Precisely described, the pointer 76 cannot be accurately aligned with the No. 1 graduation 74 by the re-adjustment according to the routine of FIG. 4. Namely, while the stepping motor 48 is not energized, the motor is maintained in a stable position by the magnetic detent force, with the rotor teeth facing the stator pole teeth, as explained above. In the manual adjustment using the thickness gauge 75, the pointer 76 is aligned with the No. 1 graduation 74 while the motor 48 is not energized. In the re-adjustment according to the mechanical error compensating routine of FIG. 4 using the switch panel 94, the stepping motor 48 is stepped with a suitable number of stepping pulses applied thereto for simultaneous excitation of two stator poles. Therefore, at the end of the re-adjustment using the switch panel 94, the motor 48 is maintained in a stable position with each rotor tooth positioned between the adjacent two stator teeth.

Consequently, there arises a deviation corresponding to a half of one stepping pulse, between the two stable positions established by the manual adjustments using the thickness gauge 75 and the switch panel 94. This results in the corresponding amount of misalignment between the position of the No. 1 graduation 74, and the position of the pointer 76 established according to the routine of FIG. 4. The half of one stepping pulse of the motor corresponds to one eighth ($\frac{1}{8}$) of one division of the scale on the calibrated surface 72 ($\frac{1}{8}$ of the spacing between the adjacent graduations 74). However, this amount of misalignment is small enough to allow the operator of the printer to recognize the graduation 74 pointed by the pointer 76.

If the ERROR COMPENSATION command is not present, a negative decision (NO) is obtained in step S1, and steps S2–S8 are not executed. The adjustment according to the mechanical error compensating routine of FIG. 4 is accomplished by the manufacturer of the printer, and the advancing pulse number Ns, compensating pulse number Nx and excitation phase of the stepping motor 48 are stored in the $E^2$ PROM 86, in steps S4, S7 and S8. Therefore, the user of the printer does not have to effect the adjustment of FIG. 4 for the purpose of storing the numbers Ns and Nx and excitation phase of the motor in the $E^2$ PROM 86. If the mechanical error compensating routine of FIG. 4 is effected by the user, the content of the $E^2$ PROM 86 is updated.

The table stored in the ROM 84, which represents the stepping pulse numbers corresponding to the individual graduations 74, is also updated when the mechanical error compensating routine of FIG. 4 is implemented. That is, the table is updated each time the advancing pulse number Ns and compensating pulse number Nx are updated. The position M1 of stepping pulses of the motor 48, as follows:

$$M1 = Ns - N1 - Nx$$

where,

Ns: Advancing pulse number necessary to advance the print head 14 from the initial position to the platen 10, N1: Retracting pulse number corresponding to the initial head gap established by the gauge 75

Nx: Compensating pulse number necessary to further retract the print head 14 until the pointer 76 is substantially aligned with the No. 1 graduation 74.

Where the distances from the No. 1 graduation 74 to the other graduations 74 (Nos. 2–7) are represented by stepping pulse numbers N2–N7 of the motor 48, respectively, the position Mn of each graduation 74 is expressed by a general formula Mn = M1 − Nn. The position Mn is updated according to this formula each time the pulse numbers Ns, Nx inherent to the specific printer are changed.

Following the mechanical error compensating routine of FIG. 4, the head gap adjusting routine of FIG. 5 is conducted. In the present printer, the head gap is adjusted in either a manual mode or an automatic mode, which is selected by the mode selector switch provided on the switch panel 94. If an AUTOMATIC ADJUSTING command is present as a result of the operation of the mode selector switch, an affirmative decision (YES) is obtained in step S101, and subsequent steps S102–S106 are implemented so that the head gap is automatically adjusted to an optimum value depending upon the particular thickness of a recording medium used.

The automatic adjusting mode begins with step S102 in which the print head 14 is first retracted to its initial position. Then, in step S103, the print head 14 is advanced toward the platen 10 on which the recording medium is placed. Upon abutting contact of the print head 14 on the recording medium, the advancing movement of the print head 14 is blocked by the platen 10, and the drive force of the stepping motor 48 is cut off by the clutch mechanism 53. In this condition, the print head 14 is forced against the recording medium by a suitable force under the biasing action of the spring 44 of the clutch mechanism 53. With the print head 14 stopped, the output signals of the encoder 54 remain unchanged, whereby the stepping motor 48 is turned off. In the meantime, the number Nc of stepping pulses applied to the motor 48 during the movement of the print head 14 from the initial position to the position of abutment with the recording medium is counted by the third counter of the RAM 88. In step S104, the counter pulse number Nc is stored in the working memory of the RAM 88.

The control flow then goes to step S105 to calculate a difference Nz between the advancing pulse number Ns and the pulse number Nc, which difference Nz represents the thickness of the recording medium. Step S105 is followed by step S106 to obtain a head gap Ny suitable for the medium thickness represented by the calculated pulse number Nz, and retract the print head 14 by a distance corresponding to a sum of the pulse number Ny and the compensating pulse number Nx. The pulse number Ny is calculated according to a formula stored in the ROM 84. The formula is prepared such that the value Ny (optimum head gap) increases with the value Nz (medium thickness). Thus, the retracting distance of the print head 14 from the recording medium consists of the distance equal to the optimum head gap Ny determined by the formula depending upon the medium thickness, and the compensating distance (represented by the compensating pulse number Nx) equal to the distance of advancement of the print head 14 due to the specific amount of mechanical error inherent to the particular printer. In this manner, the head gap is adjusted to an optimum value suitable for the specific medium thickness, with the mechanical error taken into account.

Where the manual adjusting mode is selected, a negative decision (NO) is obtained in step S101, and step S107 is implemented to apply the hold voltage of 5 V to the stepping motor 48 to establish the excitation phase stored in the $E^2$ PROM 86. In this phase, the pointer 76 is substantially aligned with the No. 1 graduation 74, as described with respect to steps S6–S8 of the mechanical error compensating routine of FIG. 4. Since one division of the scale on the calibrated surface 72 corresponds to a distance of movement of the print head 14 obtained by four stepping pulses, the application of the hold voltage to the motor 48 causes the pointer 76 to be aligned with the nearest one of the graduations 74, irrespective of the position of the print head 14 when the manual adjusting mode is selected. With the hold voltage applied to the motor 48, the operator operates the lever 64 to increase or decrease the head gap, while observing the pointer 76 moving along the calibrated surface 72. With the lever 64 released, the pointer 76 is brought into alignment with the appropriate graduation 74 corresponding to the desired head gap, since the hold voltage of 5 V is applied to establish the excitation phase stored in the $E^2$ PROM 86 in step S8. The pointer 76 is maintained in that position under the force produced by the hold voltage. If the head gap thus established is not adequate, the lever 64 is again operated to make a re-adjustment of the head gap.

In the manual adjusting mode, the head gap may also be adjusted by using the switch panel 94. Namely, the operator may operate the alpha-numeric keys on the panel 94, to designate the number of one of the graduations 74, depending upon the thickness of the recording medium. If a GRADUATION SELECT command designating the appropriate graduation 74 is present, an affirmative decision (YES) is obtained in step S108, and step S109 is executed to move the print head 14 until the pointer 76 is aligned with the newly selected graduation 74, whereby the head gap corresponding to the selected graduation is established. Described more specifically, the position Mn of the newly selected graduation 74 is compared with the position of the graduation 74 with which the pointer 76 is currently aligned, whereby the direction of movement of the print head 14 and the number of stepping pulses of the stepping motor 46 to establish the head gap corresponding to the newly selected graduation are determined or calculated. The motor 46 is operated according to the determined direction and the calculated stepping pulse number.

It will be understood that the encoder 54, E, PROM 86, portions of the CPU 82, ROM 84 and RAM 88 assigned to execute steps S102–S106, encoder processing circuit 96, and driver circuit 100 constitute automatic head gap adjusting means for implementing the automatic head gap adjustment, and the mode selector switch on the switch panel 94 functions as part of adjusting mode selecting means for selecting the automatic or manual adjusting mode. It will also be understood that the lever 64 serves as operator-controlled head gap adjusting means, while the motor stepping switch on the panel 94, $E^2$ PROM 86, portions of the CPU 82, ROM 84 and RAM 88 assigned to execute steps S107–S109, and driver circuit 100 constitute another operator-controlled head gap adjusting means.

In the illustrated embodiment described above, the pointer 76 is exactly aligned with the graduations 74 when the print head 14 is moved by the lever 76 to establish the initial head gap by using the thickness gauge 75, while the stepping motor 48 is in the non-energized area. On the other hand, the pointer 76 is somewhat misaligned with the graduations 74 when the print head 14 is moved to adjust the head gap while the motor 48 is energized by the stepping pulse voltage of 39 V on hold voltage of 5 V, as in the head gap adjusting routine of FIG. 5. However, it is possible that the pointer 76 is always exactly aligned with the graduations 74.

It is possible that when the initial head gap is established by using the thickness gauge 75, the scale plate 66 is secured to the printer frame such that the pointer 76 deviates from the No. 1 graduation 74 by a distance equal to one eighth ($\frac{1}{8}$) of one division of the scale. In this case, the pointer 76 is exactly aligned with the appropriate graduation 74 when the head gap adjustment is conducted by using the switch panel 94 (steps S108 and S109), or by using the lever 64 (step S107).

In the illustrated embodiment, the total number of stepping pulse necessary to retract the print head 14 from the recording medium so as to obtain an optimum head gap is determined without considering an amount of potential backlash of the first and second gears 32, 36. However, the potential backlash of these gears 32, 36 may be eliminated by adding a suitable number of stepping pulses sufficient to eliminate the potential backlash, to the above-indicated total number of stepping pulses for retracting the print head to establish the optimum head gap, and by advancing the print head 14 by a distance corresponding to the added number of stepping pulses, after the print head is retracted.

In the illustrated embodiment, the stepping pulse number Ny representative of an optimum head gap corresponding to the medium thickness (represented by the stepping pulse number Nz) is obtained according to the formula stored in the ROM 84. However, it is possible to use a table stored in the ROM 84, which represents a relationship between the thickness of the medium and the stepping pulse number Ny (optimum head gap). Further, the number of stepping pulses necessary to establish the head gap corresponding to the graduation 74 designated by the operator may be determined according to a suitable formula.

In the manual adjusting mode of the head gap adjusting routine of FIG. 5, the adjustment may be made by using the lever 76 (step S107) or the switch panel 94 (steps S108 and S109). However, only one of these two forms of manual adjustment may be provided. If the manual adjustment by using the switch panel 94 is not available , the compensating pulse number Nx stored in the $E^2$ PROM 86 in step S7 of FIG. 4 is not necessary. In this case, only the excitation phase of the stepping motor 48 should be stored in the $E^2$ PROM 86 in step S8 of FIG. 4, so that the manual head gap adjustment may be made in step S107 by using the lever 76, as described above.

While the power transmission for connecting the stepping motor 48 and the print head 14 incorporates the clutch mechanism 53 in the illustrated embodiment, this clutch mechanism 53 is not essential to the printer of FIGS. 1–6. If a clutch mechanism is not provided, the stepping motor 48 is operated in an out-of-synchronization manner (not stepped in response to the stepping pulses) after the print head 14 has come into abutting contact with the platen 10 or recording medium.

The illustrated printer may be adapted to determine or detect the distance of movement of the print head 14, based on the output of the encoder 56, rather than by counting the number of stepping pulses applied to the stepping motor 48.

Figure 7:
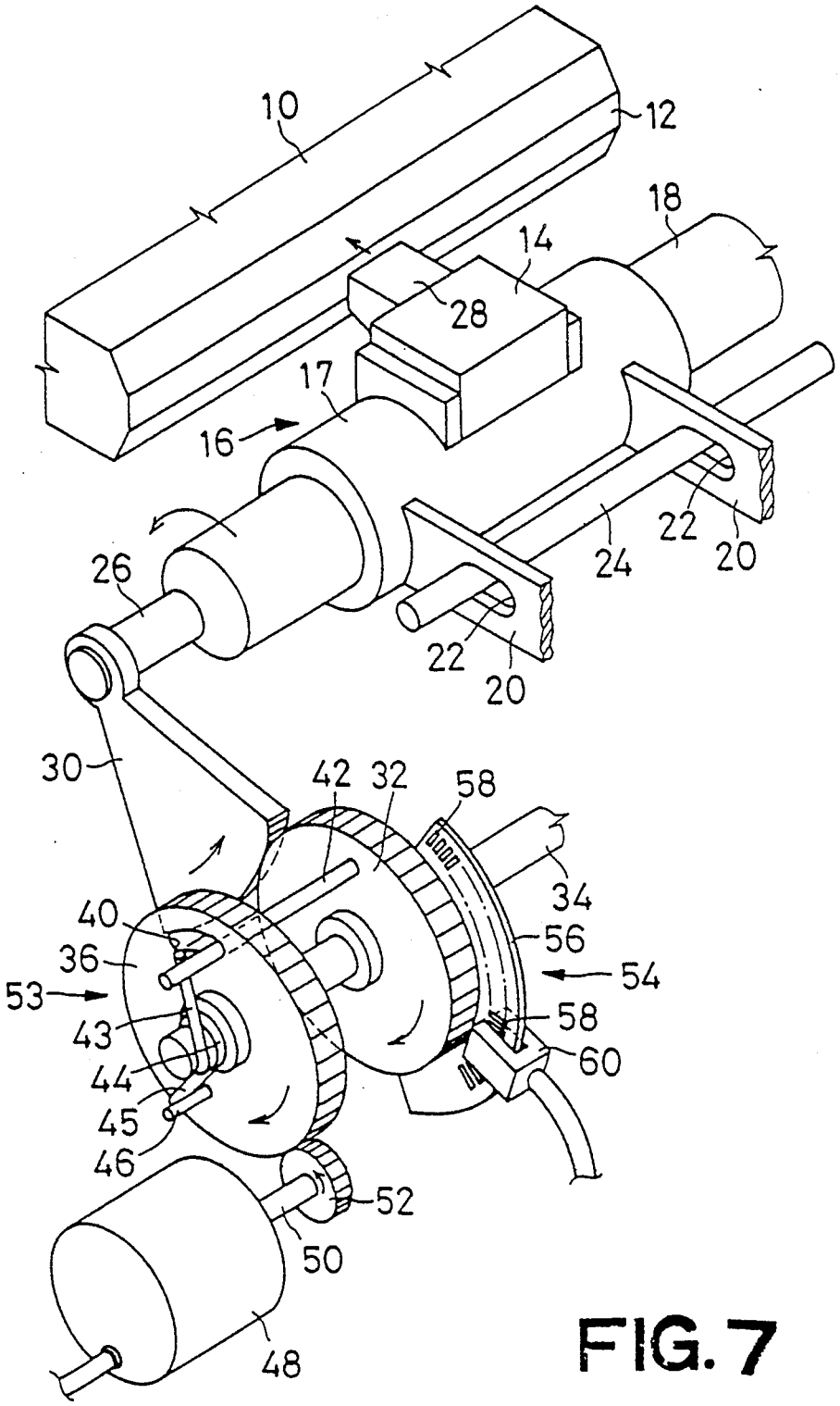
FIG. 7 is a fragmentary perspective view of another embodiment of the invention in the form of a dot matrix printer.

Referring next to FIGS. 7–13, there will be described another embodiment of the printer of the present invention. As indicated in FIG. 7, the present printer is structurally identical with the preceding embodiment, except for the elimination of the scale plate 66, lever 64, and switch panel 94. Accordingly, the present printer is not capable of adjusting the head gap by using the operator-controlled lever 64 and switch panel 94 as provided in the preceding embodiment. Further, the control device 80 does not incorporate the $E^2$ PROM 86 provided in the preceding embodiment. For easy understanding, the same reference numerals as used in FIGS. 1 and 2 will be used in FIGS. 7 and 8, to identify the functionally corresponding components. In the interest of brevity and simplification, no description of these components will be provided except for some components such as the encoder 56, ROM 84 and RAM 88.

Figure 9:
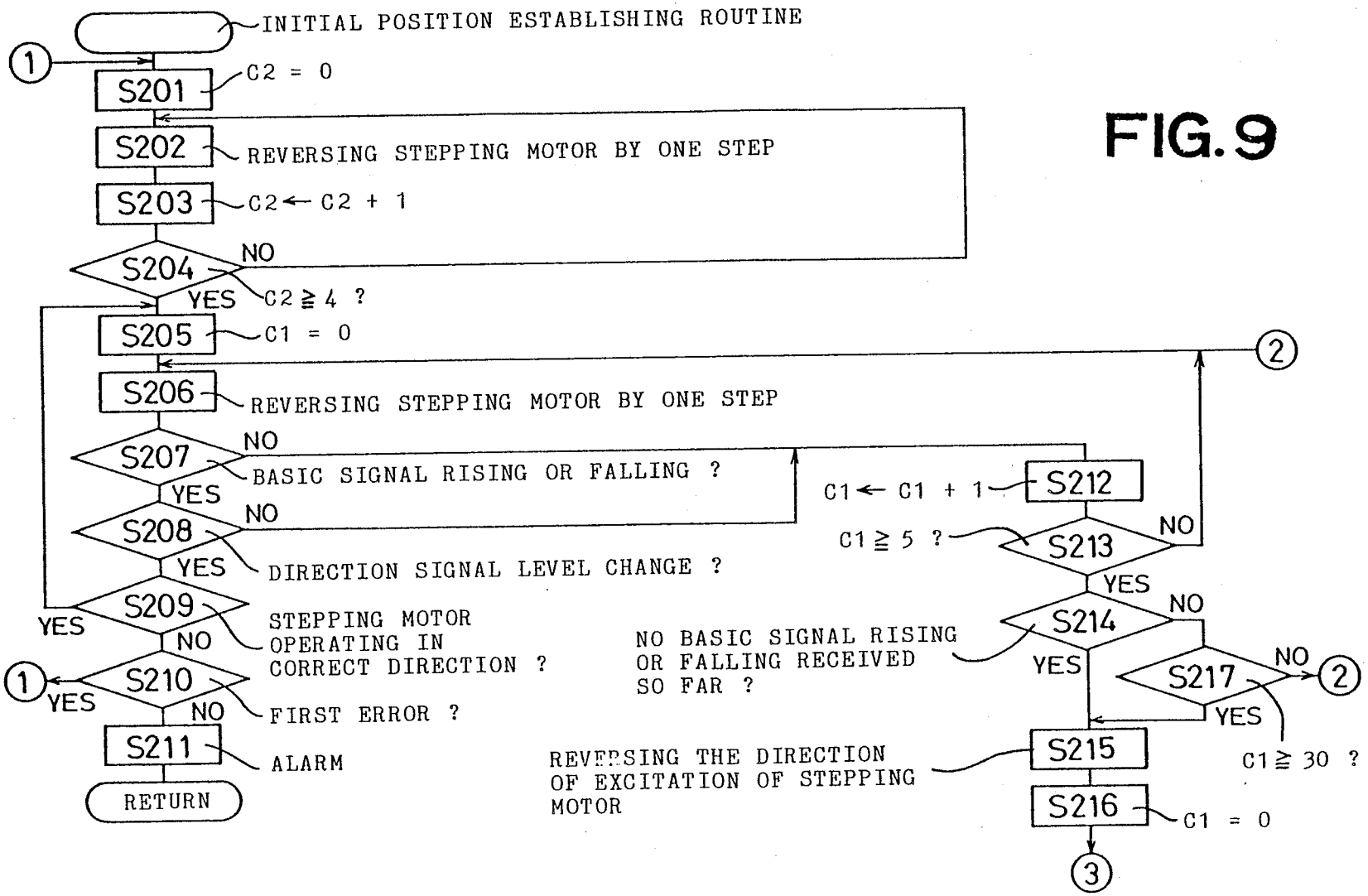
FIGS. 9 and 10 are flow charts illustrating a routine for establishing the initial position of a print head of a printer, which is stored in a read-only memory of the control system of FIG. 8.
Figure 10:
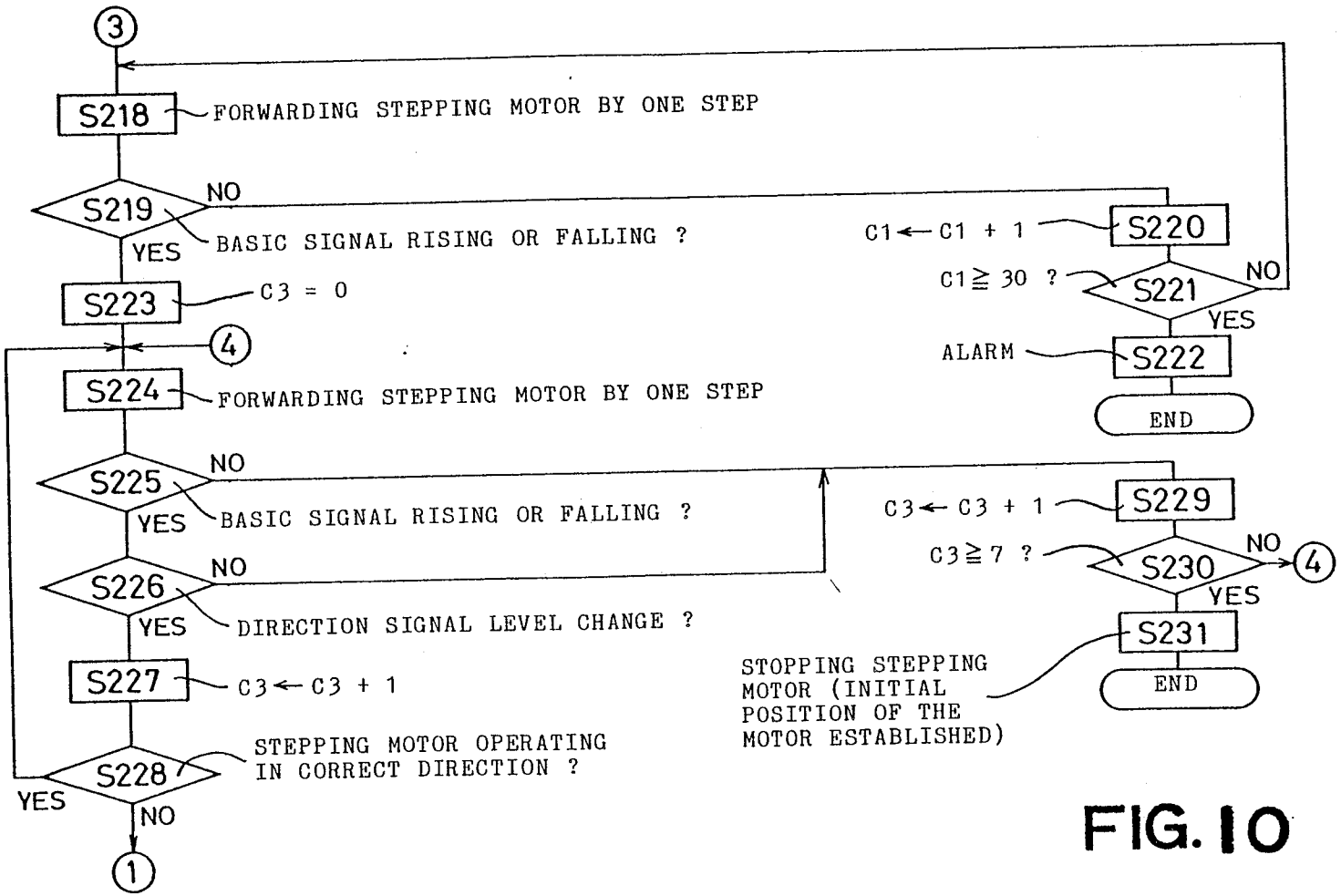
Figure 11:
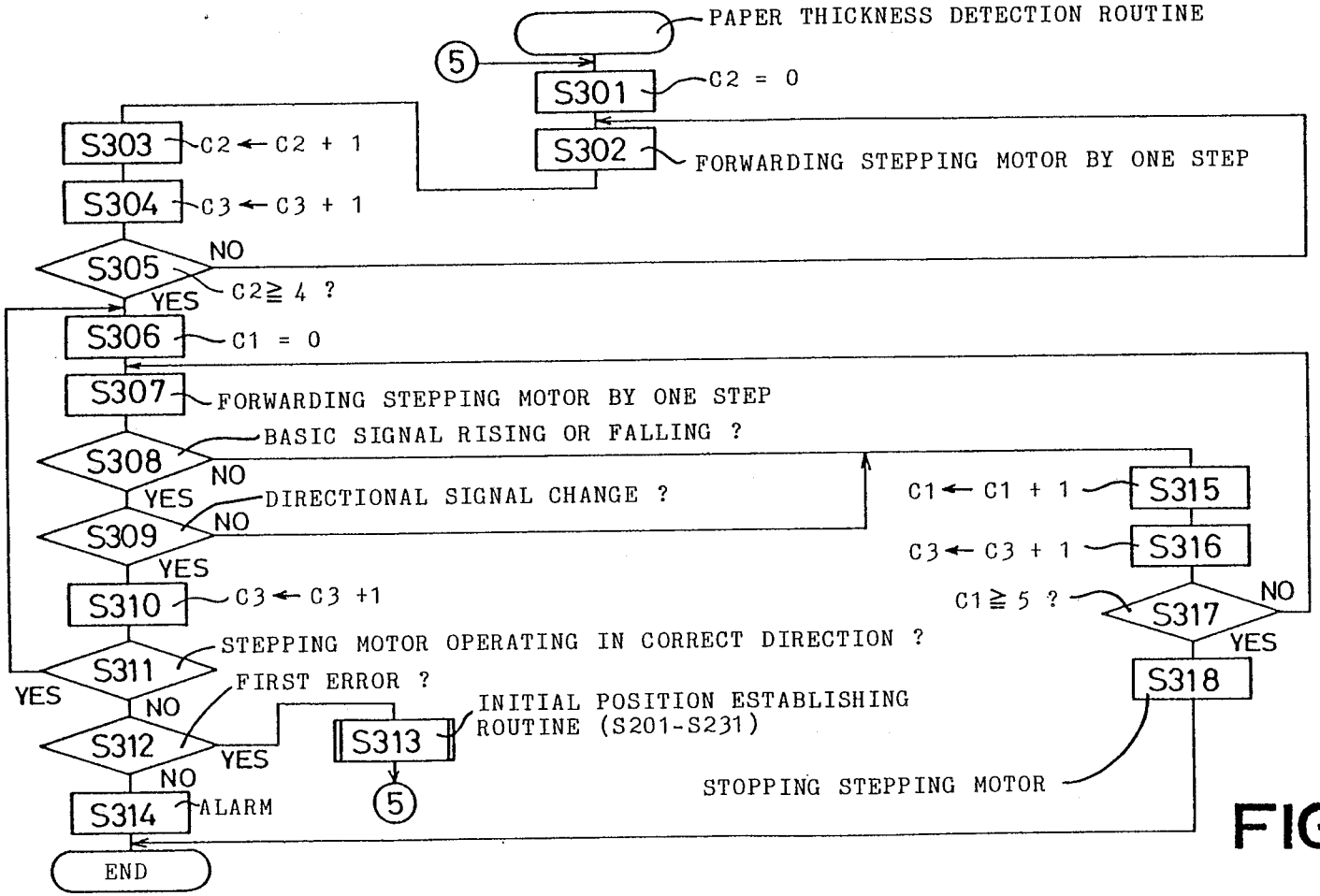
FIG. 11 is a flow chart showing a part of a paper thickness detection routine also stored in the read-only memory of FIG. 8.

ROM 84 stores an initial position establishing routine illustrated in the flow chart of FIG. 9, and a paper thickness detection routine illustrated in FIGS. 10 and 11. These routines will be described below. The RAM 88 used in the present printer also has a first, a second and a third counter similar to those indicated in FIG. 3, but the functions of these counters are different from those of the preceding embodiment, as described below.

For easier understanding of the present embodiment, the encoder 54 and the output signals of the encoder 54 will be described in greater detail.

As described above with respect to the encoder 54 in the preceding embodiment, the photo-interrupter 60 produces a basic pulse signal based on a light beam passing through the stationary basic slit member (and the movable slit member 56), and a direction pulse signal based on a light beam passing through the stationary direction slit member (and the movable slit member 56). The basic pulse signal is generated each time the print head 14 is moved by a predetermined incremental distance. Therefore, the distance of movement of the print head 14 can be detected or determined by counting the number of the basic pulses (risings and fallings of the basic pulse signal). In the present embodiment, the direction of movement of the print head can be determined by the levels of the direction pulse signal upon rising and falling of the basic pulse signal, as described below in detail.

Figure 12:
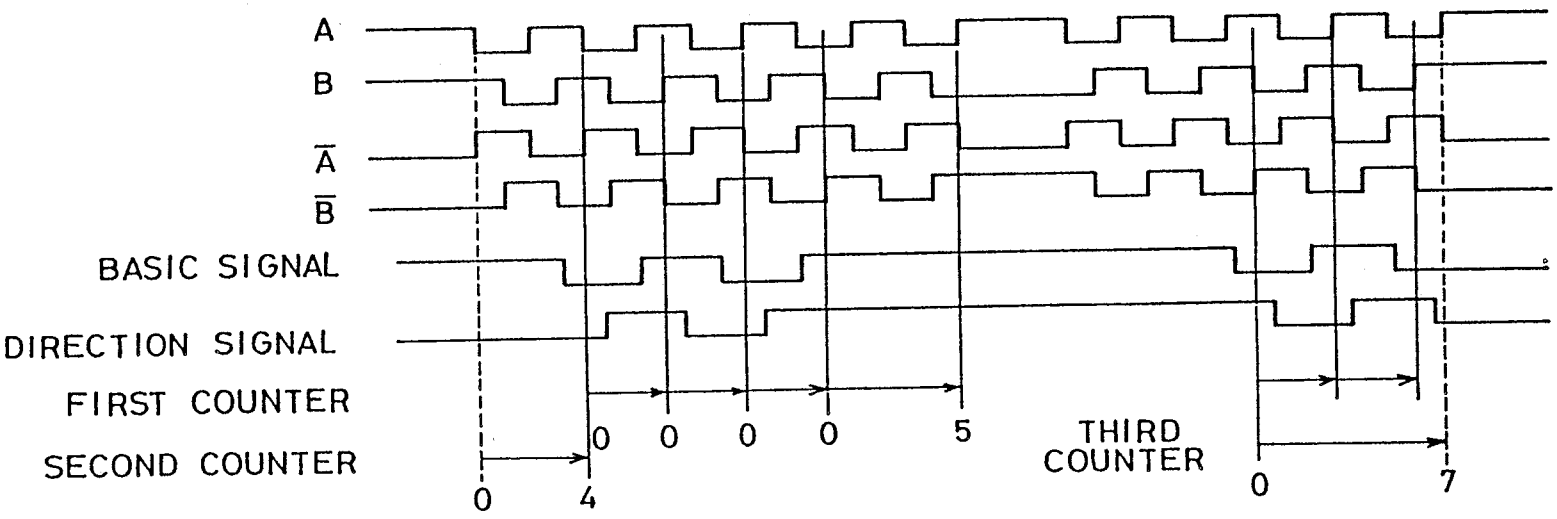
FIG. 12 is a timing chart illustrating stepping operations of a stepping motor, output signals of an encoder, and changes in the contents of a first, a second and a third counter when the initial position establishing routine is executed.

The stationary basic and direction slit members provided in the photo-interrupter 60 are adapted such that the phases of the basic and direction pulse signals are shifted from each other by one quarter of the period, so that the level of the direction pulse signal upon rising of the basic pulse signal is different from that of the direction pulse signal upon the preceding or following falling of the basic pulse signal, as indicated in FIG. 12.

Suppose the photo-interrupter 60 is adapted such that the level of the direction pulse signal upon falling of the basic pulse signal is "0" while that of the direction pulse signal upon rising of the basic pulse signal is "1" when the stepping motor 48 is stepped in the clockwise direction to retract the print head 14, the levels of the direction pulse signal upon the falling and rising of the basic pulse signal are "1" and "0", respectively, when the stepping motor 48 is stepped in the counterclockwise direction to advance the print head 14. Therefore, the direction of stepping operation of the motor 48, i.e., the direction of movement of the print head 14 can be determined based on the levels of the direction pulse signal upon the falling and rising of the basic pulse signal.

The spacing of the slits 58 of the movable slit member 56 (sector plate) is determined so that the period of the basic and direction pulse signals of the encoder 54 is 1.5 times that of the period of the stepping pulses applied to the stepping motor 48. The number of the slits 58 is large enough to cover the advancing and retracting stroke of the print head 14. Further, a suitable stop is provided to mechanically stop the rotation of the sector plate or movable slit member 56 when the boundary between the slit portion and non-slit portion of the movable slit member 56 is moved past the photo-interrupter 60 by a distance corresponding to 20 stepping pulses of the motor 48.

Referring to the flow charts of FIGS. 9–11, there will be described the manner of establishing the initial position of the print head 14, and the manner of detecting the thickness of the recording medium.

Before the thickness of the recording medium is detected, the initial position of the print head 14 is established. The timing chart of FIG. 12 indicates the changing states of the excitation phases of the stepping motor 48 and the output signals of the encoder 54, and the changing contents of the first, second and third counters of the RAM 88, when the initial position establishing routine of FIGS. 9 and 10 are executed.

The initial position establishing routine begins with step S201 in which the second counter is reset. In the following step S202, the stepping motor 48 is operated by one step in the reverse direction to retract the print head 14. Step S202 is followed by step S203 in which the content C2 of the second counter is incremented. Then, step S204 is implemented to determine whether the content C2 is equal to "4" or higher, or not. In the first cycle of execution of the routine, a negative decision (NO) is obtained in step S204, and the control flow goes back to step S202. When the motor 48 is reversed by four steps with simultaneous excitation of two phases sequentially occurring in the direction of $\overline{A}$, $\overline{B}$, A and B, as indicated in FIG. 12, an affirmative decision (YES) is obtained in step S204, whereby step S205 and subsequent steps are implemented. Steps S201–S204 are implemented for the described below.

When the stepping motor 48 is operated, the rotation of the second gear 36 is transmitted to the first gear 32 through the clutch mechanism 53, but the rotation of the first gear 32 may be delayed with respect to that of the second gear 32, due to deflection of the connecting rod or pin 42. In this case, the stepping pulses applied to the motor 48 may be counted even while the print head 14 is not moving (i.e., before a movement of the print head 14 is started). This may cause the control device 80 to determine that the clutch mechanism 53 has been placed in its disconnecting state, although the clutch mechanism 53 is not in fact in the disconnecting state. To avoid the possible delay of the movement of the print head 14 with respect to the first stepping pulse applied to the stepping motor 48, the stepping motor 48 is initially operated in the reverse direction by a suitable amount necessary to eliminate the above delay and the consequent erroneous determination on the operating state of the clutch mechanism 53. To this end, steps S202–S204 are executed.

It is further noted that during an initial period of operation of the stepping motor 48, a relatively large torque is required to rotate the first gear 32, due to inertia of the gears 32, 36, 30, support shaft 18, carriage 16, etc. This results in a relatively large amount of deflection of the connecting pin 42 (relatively large amount of deflection of the spring 44, if the motor 48 is operated to advance the print head 14). However, after the gear 32 has begun to rotate at a constant speed, the torque to drive the gear 32 and the other elements decreases, and the amount of deflection of the connecting pin 42 becomes negligibly small. In this condition, the period of the basic pulse signal more or less fluctuate, but the fluctuation does not substantially deteriorate the accuracy of establishing the initial position of the print head 14.

With an affirmative decision obtained in step S204, the control flow goes to step S205 to clear the first counter, and to step S206 in which the stepping motor 48 is reversed by one step. Step S206 is followed by step S207 to determine whether there is an occurrence of rising or falling of the basic pulse signal, and step S208 to determine whether the level of the direction pulse signal has been changed, i.e., whether the level of the direction pulse signal corresponding to the present occurrence of rising or falling of the basic pulse signal is different from that of the direction pulse signal corresponding to the last occurrence of falling or rising of the basic pulse signal.

If the rotation of the stepping motor 48 is normally transmitted to the print head 14, the basic pulse signal rises and falls at a constant frequency in response to the rotation of the movable slit member 56. At the same time, the level of the direction pulse signal changes alternately between the two values. Therefore, during an operation of the motor 48 with a predetermined number ("5" in this specific example) of stepping pulses applied thereto in step S206, an affirmative decision (YES) is necessarily obtained in step S207, and an affirmative decision is obtained also in step S208. The rise and fall of the basic pulse signal usually occur during a normal movement of the print head 14, but may occur due to a vibrating movement of the print head 14. In the latter case, the detection of the rising and falling of the basic pulse signal may cause an error. However, the vibrating movement of the print head 14 does not cause the level of the directional pulse signal to change. Therefore, the detection of a change in the level of the directional pulse signal between the moments of the successive rising and falling of the basic pulse signal assures accurate determination of the normal movement of the print head 14. That is, the detected rising or falling of the basic pulse signal due to the vibration is ignored if the level of the direction pulse signal remains unchanged between the successive rising and falling of the basic pulse signal. Thus, an erroneous determination on the movement of the print head can be avoided.

If an affirmative decision is obtained in both of steps S207 and S208, the control flow goes to step S209 to determine whether the stepping motor 48 is stepped in the correct direction, or not. This determination is effected based on the levels of the direction pulse signals upon detection of the rising and falling of the basic pulse signal, since the levels of the direction pulse signals in relation to the rising and falling of the basic pulse signal are known for the forward and reverse operating directions of the stepping motor 48, as explained above. If the detected levels of the direction pulse signals satisfy the known relationship for the reverse direction of the motor, the motor is operating in the correct direction, in this case. If not, the motor is operating in the wrong direction, for some reason or other such as an out-of-synchronization operation in which the motor 48 is not following the stepping pulses. If the motor 48 is stepped in the correct direction, an affirmative decision is obtained in step S209, and the control flow returns to step S205. If the motor is operated in the wrong direction, step S209 is followed by step S210 to determine whether the operation in the wrong direction occurs for the first time, or not. When a negative decision (NO) is obtained for the first time in step S209, a suitable flag in the RAM 88 is set to "1". If this flag is reset, an affirmative decision is obtained in step S210, and the control flow returns to step S201, whereby steps S201–S209 are repeated. If the operating direction of the motor 48 is not corrected during the repeated execution of steps S201–S209, a negative decision is obtained in step S210, whereby step S211 is executed to provide an alarm, informing the operator of the error.

If the stepping motor 48 is rotating in the correct direction, i.e., in the reverse direction, steps S205–S209 are repeatedly executed. Since the period of the basic pulse signal is 1.5 times that of the stepping pulses applied to the stepping motor 48, there is a possibility that neither a rise nor a fall of the basic pulse signal occurs for a certain time length, even while the print head 14 is normally retracted. In this case, a negative decision is obtained in step S207, and the control flow goes to step S212 in which the count C1 of the first counter is incremented. Step S212 is followed by step S213 to determine whether the count C1 is equal to or larger than the predetermined value, i.e., "5", or not. If a negative decision is obtained in step S213, the control flow returns to step S206. While the occurrences of the rising and falling of the basic pulse signal are detected in step S207, step S205 is executed following steps S208 and S209, whereby the first counter is reset to zero. Therefore, an affirmative decision (YES) is not obtained in step S213, as long as the print head 14 is retracted, and the first counter is repeatedly reset to zero, as indicated in the timing chart of FIG. 12.

When the boundary between the slit portion (having the slits 58) and the non-slit portion of the movable slit member 56 has reached the photo-interrupter 60, there occurs no rising or falling of the basic pulse signal, whereby a negative decision (NO) is obtained in step S207, and step S213 is implemented to determine whether the count C1 is equal to "5" or larger. For a short time after the above-indicated boundary has reached the photo-interrupter 60, a negative decision is obtained in step S213, and the control flow goes back to step S206. In this instance, the basic pulse signal does not undergo rising or falling, and a negative decision is made in step S207. Thus, the first counter is not reset, and steps S206, S207, S212 and S213 are repeatedly implemented until an affirmative decision (YES) is obtained in step S213. The function of the first counter whose preset value is "5" is to accurately determine that the basic reference signal is absent due to the stopping of the print head 14. Namely, a negative decision may be obtained in step S207 (the first counter is incremented) even while the print head 14 is still moving.

If an affirmative decision is obtained in step S213, step S214 is implemented to determine whether no rising or falling of the basic pulse signal has occurred so far. If a rising or falling of the basic pulse signal occurs, a suitable flag in the RAM 88 is set, and the determination in step S214 is made based on the state of that flag. If a rising or falling of the basic pulse signal has ever occurred, an affirmative decision (YES) is obtained in step S214, and the control flow goes to step S215 in which the direction of excitation of the stepping motor 48 is reversed, namely, the exciting direction of $\overline{A}$, $\overline{B}$, A, B to retract the print head 14 is changed to the exciting direction of B, A, $\overline{B}$, $\overline{A}$ to advance the print head, as indicated in the chart of FIG. 12. Then, the first counter is reset to zero in step S216. If no rising or falling of the basic pulse signal has ever occurred, a negative decision is obtained in step S214. This case will be described later.

Step S216 is followed by step S218 wherein the stepping motor 48 is stepped in the forward direction to advance the print head 14. Step S218 is followed by step S219 to determine whether there exists a rising or falling of the basic pulse signal. In this connection, it is noted that the print head 14 is retracted by a distance corresponding to five stepping pulses (see step S213 ) after the boundary of the slit portion and non-slit portion of the movable slit member 56 has passed the photo-interrupter 60. Therefore, a negative decision is obtained in step S219 for some time length after an affirmative decision is obtained in step S213. In this case, the count C1 of the first counter is incremented in step S220, and step S221 is implemented to determine whether the count C1 has reached a preset value of "30". Initially, a negative decision is obtained in step S221, and the control flow returns to step S218.

When the above-indicated boundary of the movable slit member 56 has passed the photo-interrupter 60, an affirmative decision is obtained in step S219, and step S223 is executed to reset the third counter. The control flow then goes to step S224 in which the stepping motor 48 is stepped in the same direction as in step S218, i.e., in the forward direction to advance the print head. Step S224 is followed by steps S225 and S226 similar to steps S207 and S208. While the print head 14 is normally advanced, the basic pulse signal repeats successive rising and falling and the level of the direction signal alternately changes between the two values, whereby an affirmative decision is made in steps S225 and S226, and step S227 is implemented to increment the third counter. Then, step S228 is implemented to determine whether the stepping motor 48 is stepped in the correct direction, or not, i.e., in the forward direction to advance the print head 14. If an affirmative decision is obtained in step S228, the control flow goes back to step S224. If the motor 48 is operated in the wrong direction for some reason or other, the control flow returns to step S201 to again retract the print head 14, to thereby eliminate the source of the wrong operation direction (out-of-synchronization of the motor 48).

A negative decision (NO) may be obtained in step S225 due to the difference between the periods of the basic pulse signal and the stepping pulses, even while the motor 48 is stepped in the correct direction and the print head 14 is normally advanced. In this case, the count C3 of the third counter is incremented in step S229, and step S230 is implemented to determine whether the count C3 has reached a predetermined value of "7". That is, the number of all the stepping pulses applied to the stepping motor 48 to advance the print head after the print head is retracted is counted by execution of steps S227 and S229. When the counter C3 has reached "7", an affirmative decision is obtained in step S230, step S231 is executed to stop the stepping motor 48. In other words, the motor 48 is turned off to stop the print head 14, at a position which is seven stepping pulses ahead of the position at which the first rising or falling of the basic pulse signal occurs after an affirmative decision is obtained in step S213. This position at which the print head is stopped is referred to as "initial position" of the print head 14, and "reference position" of the encoder 54.

As described above, the initial position of the print head 14 is established by advancing the print head by a distance corresponding to seven stepping pulses of the motor 48 after the exciting direction of the motor is reversed to the forward direction in step S215 and the first occurrence of rising or falling of the basic pulse signal is detected in step S219. This arrangement avoids an out-of-synchronization operation of the stepping motor 48 which would take place if the initial position establishing routine of FIGS. 9 and 10 is commanded to be implemented while the print head is located at an otherwise preset initial position. More specifically, the basic pulse signal necessarily undergoes a rising or falling during a retracting movement of the print head 14 from the initial position, and the print head 14 is protected from being forced to stop, with the movable slit member 56 abutting against the stop indicated above, which causes an out-of-synchronization phenomenon of the motor.

If a negative decision (NO) is obtained in step S214, that is, if no rising or falling of the basic pulse signal has been detected while the stepping motor 48 is stepped in the reverse direction in step S206, the control flow goes to step S217 to determine whether the count C1 of the first counter has reached a predetermined value of "30" or not. This determination is initially negative, and steps S206 and S207 are executed. Thus, the first counter is incremented until a first affirmative decision is obtained in step S217. If the count C1 reaches "30", this indicates that no rising or falling of the basic pulse signal occurs due to some trouble in the retracting movement of the print head 14. In this case, steps S215, S216 and S218–S221 are implemented, to check to see if the print head 14 can be normally advanced. If the print head 14 cannot be properly advanced, an affirmative decision is obtained in step S221, and an alarm is constituted in step S222.

If a rising or falling of the basic pulse signal is detected in step S207 before the count C1 reaches "30" in step S217, step S205 is implemented to reset the first counter, and the first counter is incremented in step S212 each time the basic pulse signal rises or falls. When the count C1 reaches "5" in step S213, the print head is advanced and moved to the initial position (steps S215, S216, S218, S219, S223–S231).

In the case where the present initial position establishing routine of FIGS. 9 and 10 is initiated while the movable slit member 56 of the encoder 54 is positioned such that the non-slit portion is aligned with the photo-interrupter 60, the basic pulse signal does not rise or fall, and the movable slit member 56 abuts against the stop, whereby the motor 48 suffers from an out-of-synchronization phenomenon. In this case, an affirmative decision is made in step S217, but there exists no trouble with the printing apparatus. Therefore, an affirmative decision is obtained in step S219 after the stepping motor 48 is operated in the forward direction (steps S215, S218), and the print head 14 can be eventually moved to the initial position.

Figure 13:
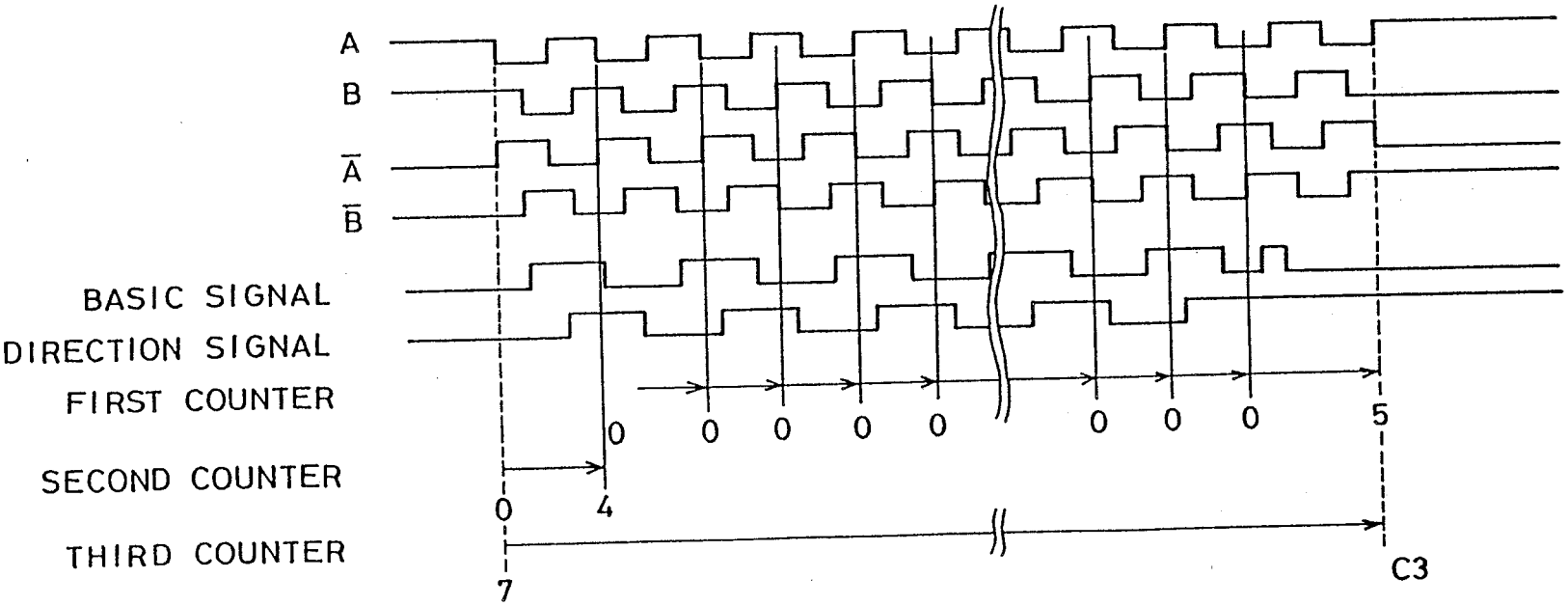
FIG. 13 is a timing chart similar to that of FIG. 12, in connection with the paper thickness detection routine.

Reference is now made to the flow chart of FIG. 11 which illustrates the paper thickness detecting routine, and the timing chart of FIG. 13 which shows stepping operations of the stepping motor 48, changing states of the output of the encoder 54, and changing contents of the three counters. This routine is initiated without a recording medium placed on the platen 10, starting with step S301 in which the count C2 of the second counter is reset. Then, step S302 is executed to step the motor 48 in the forward direction to advance the print head 14 toward the platen 10. Step S302 is followed by steps S303 and S304 in which the counts C2 and C3 of the second and third counters are incremented. Then, the control flow goes to step S305 to determine whether the count C2 of the second counter has reached a predetermined value of "4". Steps S302–S305 are provided to avoid a processing error due to a delay of the print head movement with respect to the stepping operation of the motor 48, which may be caused by deflection of the spring 44 of the clutch mechanism 44, for example. If an affirmative decision (YES) is obtained in step S305, step S306 is implemented to reset the first counter, and step S307 is implemented to step the stepping motor 48 in the forward direction. Then, steps S308 and S309 similar to steps S207 and S208 (steps S225 and S226) are executed, to detect an advancing movement of the print head 14. In the next step S310, the accumulative number of stepping pulses applied to the motor 48 after the commencement of the advancing movement of the print head 14 is counted. Steps S310 is followed by step S311 to determine whether the stepping motor 48 is operated in the correct direction, i.e., in the forward direction. If the operating direction is correct, the control flow returns to step S306.

If a rising or falling of the basic pulse signal does not occur, a negative decision is made in step S308, and steps S315 and S316 are implemented to increment the first and third counters, respectively. Then, step S317 is implemented to determine whether the count C1 has reached a predetermined value of "5". Provided that the print head 14 is normally advanced, an affirmative decision is obtained in steps S308 and S309 before an affirmative decision is obtained in step S317, and the first counter is repeatedly reset in step S306, as indicated in the timing chart of FIG. 13, and the total number of the stepping pulses applied to the motor 48 during the advancing movement of the print head 14 is counted by the third counter.

When the print head 14 is brought into abutting contact with the platen 10, the clutch mechanism or torque limiter 53 is brought into its disconnecting state, cutting off the transmission of a drive force from the motor to the print head 14. Consequently, the print head 14 is stopped, and the basic pulse signal does not rise or fall, whereby a negative decision is obtained in step S308. In this respect, it is noted that the movable slit member 56 may slightly oscillate due to vibration upon abutment of the print head 14 against the platen 10. In this event, the rise and fall of the basic pulse signal may occur at a relatively high frequency, as indicated at the right-hand side end in the timing chart of FIG. 13. However, the level of the direction pulse signal remains stable or unchanged, whereby a negative decision is obtained in step S309. Thus, the situation is treated as if a negative decision is obtained in step S308. This arrangement therefore permits accurate determination that the print head 14 is stopped, when the count C1 has reached "5". Namely, an affirmative decision in step S317 indicates that the clutch mechanism 53 is placed in its disconnecting state and the print head 14 is stopped. Step S317 is followed by step S318 in which the stepping motor 318 is turned off. It will be understood that the count C3 of the third counter when the motor 48 is stopped or when the termination of the advancement of the print head 14 is detected represents a distance between the position from which the print head is advanced, and the position of the platen 10.

If the stepping motor 48 is stepped in the wrong direction and a negative decision is obtained in step S311, step S312 is executed to determine whether the negative decision in step S311 is obtained for the first time or not. If so, an affirmative decision is obtained in step S312, and step S313 is executed to effect the initial position establishing routine of FIGS. 9 and 10. If the trouble of the motor 48 in connection with the operating direction cannot be removed as a result of the initial position establishing routine, a negative decision is obtained in the next execution of step S312, and step S314 is implemented to provide an alarm.

After the advancing distance of the print head 14 to the platen 10 has been stored in the RAM 88 in the form of the count C3 of the third counter, a suitable recording paper is placed on the platen 10, and the paper thickness routine consisting of steps S301–S318 is executed again, in order to detect the thickness of the paper. In the case, the advancing distance of the print head 14 to the surface of the recording paper is obtained as the count C3 of the third counter. Therefore, the thickness of the paper can be calculated by subtracting the currently obtained count C3 from the previously obtained count C3. This calculation is accomplished according to a suitable control program. An optimum head gap corresponding to the calculated paper thickness is calculated in the form of the number of stepping pulses of the stepping motor 48, based on a suitable formula stored in the ROM 84. The print head 14 is retracted from the position of abutting contact with the paper, by a distance corresponding to the calculated stepping pulse number. Thus, the head gap between the print head 14 and the paper is suitably adjusted, depending upon the specific thickness of the paper.

It will be understood from the foregoing description that the encoder 54, encoder processing circuit 96, and portions of the control device 80 assigned to execute steps S306–S311 and S315–S317 constitute clutch release detecting means for detecting the disconnecting state of the clutch mechanism 53, and that the encoder 54, encoder processing circuit 96, driver circuit 100, and portions of the control device 80 assigned to execute steps S301–S318 constitute automatic head gap adjusting means for automatically adjusting the head gap.

In the present second embodiment of FIGS. 7–13, too, the clutch mechanism 53 serving as a torque limiter uses the connecting rod or pin 42 and spring 44. However, the torque limiter may be provided by a suitable frictional coupling clutch.

While the drive force of the stepping motor 48 is imparted to the print head 14, in the form of a rotary motion through the gears 30, 32, 36, etc., the rotary motion of the motor 48 may be converted into a linear movement imparted to the print head. In this case, the clutch mechanism may be adapted to cut off a linear drive force which exceeds a preset value, rather than a torque larger than a preset value.

Although the distance of movement of the print head 14 is detected as the number of stepping pulses applied to the stepping motor 48, the movement distance may be detected based on the basic pulse signal produced by the encoder 54.

In the embodiment of FIGS. 7–13, the movement of the print head 14 is detected by the encoder 54, and the disconnecting state of the clutch mechanism or torque limiter 53 is detected by determining that the output signal of the encoder 54 is absent, even while the stepping pulses. are not applied to the stepping motor 48. However, the disconnection of the clutch mechanism may be detected by using a sensor which is adapted to detect the disconnecting state of the clutch mechanism itself.

Figure 14:
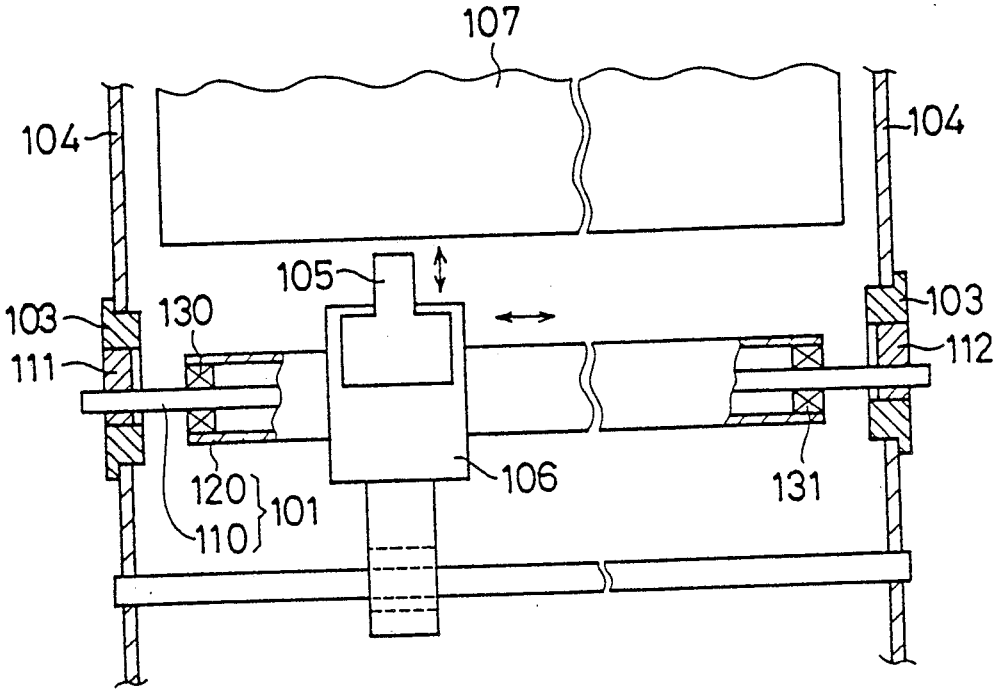
FIG. 14 is a fragmentary, partially cut-away plan view showing a printing mechanism of a printer according to a further embodiment of the present invention.
Figure 15:
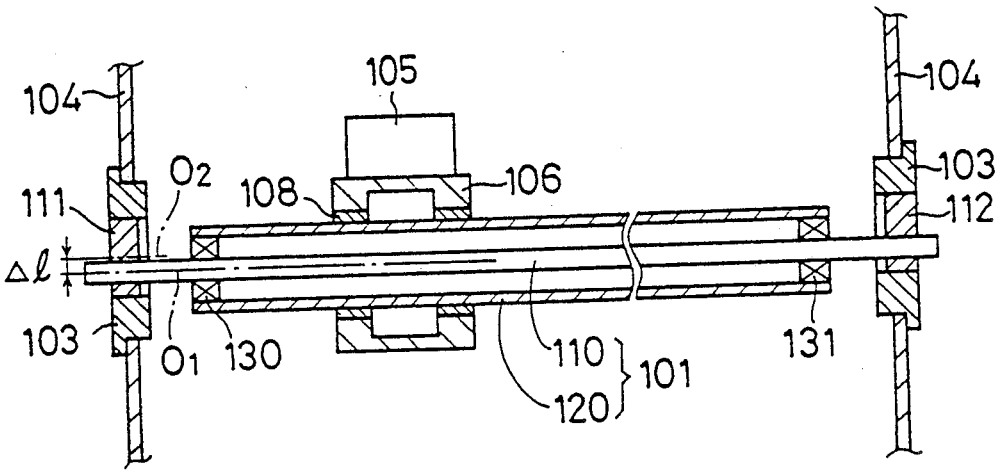
FIG. 15 is an elevational view in longitudinal cross section of a carriage guide structure of the printer of FIG. 14.
Figure 16:
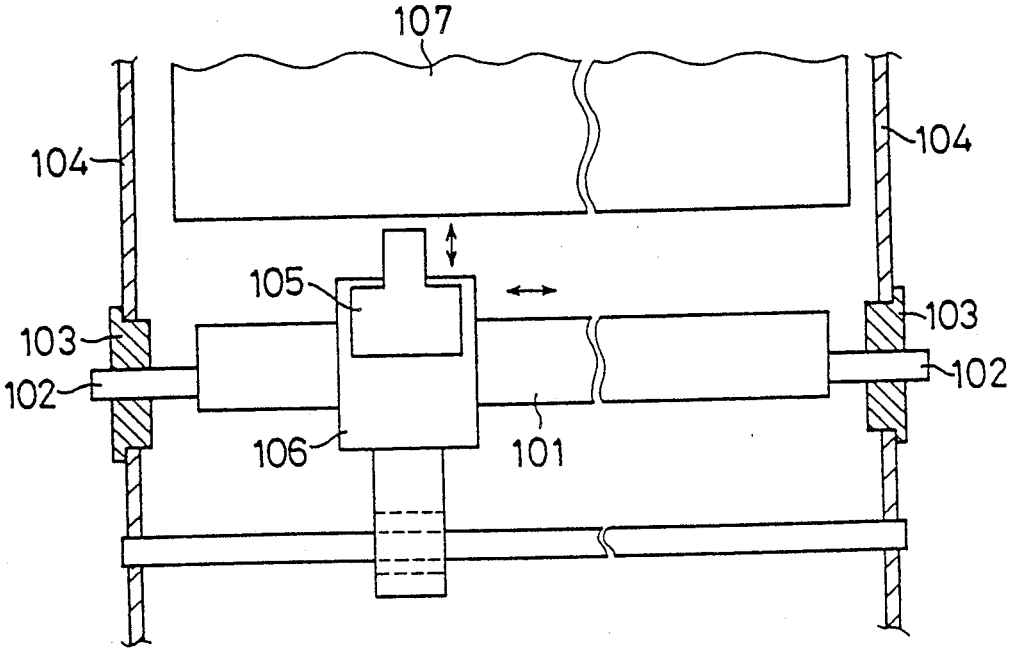
FIG. 16 PRIOR ART
FIG. 16 is a plan view corresponding to that of FIG. 14, showing a printer having a conventional carriage guide structure.
Figure 17:
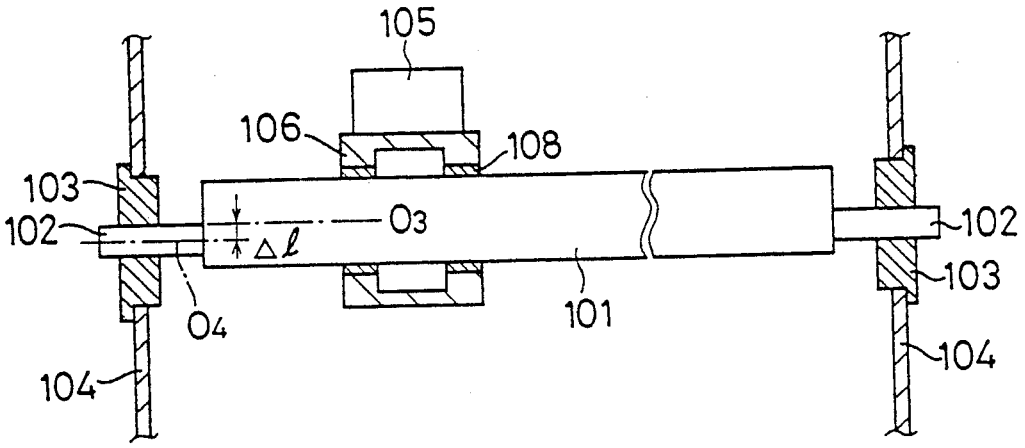
FIG. 17 PRIOR ART
FIG. 17 is a cross sectional view of the printer of FIG. 16, corresponding to that of FIG. 15.

Referring next to FIGS. 14 and 15, a further embodiment of the present invention in the form of a dot matrix printer having print wires will be described.

The printer has a guide shaft 101 which extends between a pair of parallel spaced-apart side walls 104. The guide shaft 101 is rotatably supported at its opposite ends by a pair of bearings 103 fixed in the respective side walls 104. The guide shaft 101 supports a carriage 106 such that the carriage 106 is slidable on the guide shaft 101 through a bearing metal 108, in the longitudinal direction of the shaft 101 parallel to the length of a platen 107 disposed between the side walls 104. The carriage 106 carries a print head 105 fixedly mounted thereon such that the print head 105 faces the platen 107.

The guide shaft 101 includes a center rod 110 and, a cylindrical hollow guide sleeve 120 disposed radially outwardly of center rod such that the center rod 110 and the hollow guide sleeve 120 are coaxial with each other and are rotatable relative to each other. The center rod 110 has a pair of eccentric collars 111 secured to its opposite ends such that the eccentric collars 111 are eccentric with the center rod 110 and are rotatably supported in the respective bearings 103. It will be understood that the center rod 110 and the eccentric collars 111 constitute an eccentric support shaft for supporting the hollow guide shaft 120 such that the eccentric support shaft 110, 111 and the guide sleeve 120 are rotatable with each other. Namely, the center rod 110 functions as an intermediate portion of the eccentric support shaft 110, 111, while the collars 111 serve as opposite end portions of the support shaft 110, 111 which are eccentric with the intermediate portion 110. The hollow guide sleeve 120 are rotatably supported by the eccentric support shaft 110, 111, through a pair of bearings 130, 131 interposed between the hollow guide sleeve 120 and the intermediate portion 110 of the eccentric support shaft 110, 111.

The carriage 106 is mounted slidably on the hollow guide sleeve 120 such that the carriage 106 is movable in the longitudinal direction of the sleeve 120, parallel to the platen 107.

As indicated in FIG. 15, the axes of rotation O2 of the collars 111 are offset from the axis of rotation O1 of the center rod 110, by a radial distance $\Delta l$, so that the rotation of the eccentric support shaft 110, 111 causes the carriage 106 and the print head 105 to be advanced and retracted in the transverse direction of the guide shaft 101, toward and away from the platen 107.

In operation of the printer, the eccentric support shaft 110, 111 is displaced toward the platen 107, when the eccentric support shaft 110, 111 is rotated in one direction by a stepping motor as indicated at 48 in FIGS. 1 and 7. Since the hollow guide sleeve 120 is rotatably supported by the intermediate portion 110 of the eccentric support shaft 110, 111 through the bearings 130, 131, the hollow guide sleeve 120 is displaced in the same direction by the same distance as the eccentric support shaft, without rotation of the hollow guide sleeve 120 relative to the platen 107. As a result, the carriage 106 and the print head 105 are advanced as a unit toward the platen 107, without rotation relative to the platen.

Thus, there arises no relative rotation between the carriage 106, and the hollow guide sleeve 120 slidably supporting the carriage 106. This arrangement avoids a variation in the force of abutting contact of the print head 105 with the platen 107, which would conventionally occur if a foreign matter is caught between the bearing metal 108 of the carriage 106 and the outer sliding surface of the hollow guide sleeve 120.

When the eccentric support shaft 110, 111 is rotated in the opposite direction, the hollow guide shaft 120, carriage 106 and print head 105 are displaced as a unit away from the platen 107, in the same manner as described above.

In the present embodiment, the carriage 106, eccentric guide shaft 110, 111 and hollow guide sleeve 120 constitute part of a device for advancing and retracting the print head 105 relative to the platen 107. This head advancing and retracting device is used to detect the thickness of a recording medium, and adjust the head gap. More particularly, the selected recording medium is placed on the platen 107, and the print head 105 is advanced from its initial position until the print head 105 comes into abutting contact with the surface of the recording medium. The distance of advancement of the print head 105 is detected and compared with a known distance between the initial position and the platen 107, to determine the thickness of the medium, as described in detail with respect to the second embodiment of FIGS. 7–13. The print head 105 is then retracted by a suitable distance away from the recording medium, to establish an optimum head gap between the medium surface and the print head 105, as also described above in detail.

It is noted that a variation in the resistance to rotation of the bearing 130, 131 may affect the force of abutting contact of the print head 105 with the recording medium or platen 107. While the variation in the rotational resistance of the bearings 130, 131 may be caused by the entry of a foreign matter, the bearings 130, 131 are interposed in the hollow guide sleeve 120, and are spaced away from the source of the foreign matter such as paper particles removed from the recording medium. Further, the guide sleeve 120 does not slide on the center rod or intermediate portion 110 of the eccentric support shaft 110, 111, and there arises substantially no entry of foreign matter into the bearings. Also, the bearings 130, 131 may be easily protected from exposure to the foreign matter. Thus, the bearings 130, 131 may be substantially free of a variation in the rotational resistance which may affect the pressure between the print head 105 and the surface of the recording medium (platen 107).

Although the printers illustrated above are dot matrix printers using print wires, the principles of the present invention is applicable to other types of printers such as ink jet printers.

While the present invention has been described in its presently preferred embodiments for illustrative purpose only, it is to be understood that the invention is not limited to the details of the illustrated embodiments and the alterations and modifications indicated above, but various other changes, modifications and improvements which may occur to those skilled in the art may be made in the printer of the present invention, in connection with the head advancing and retracting device and the head gap adjusting arrangement, for example, without departing from the spirit and scope of the invention defined in the following claims.

What is claimed is:

1. A printing apparatus comprising:

a platen for supporting a recording medium;

a print head disposed movably in a transverse direction toward and away from said platen;

a head advancing and retracting device for moving said print head in said transverse direction;

automatic head gap adjusting means for controlling said head advancing and retracting device to advance said print head until the print head comes into contact with said recording medium and then retracting the print head by a predetermined distance, to thereby adjust a head gap between said recording medium and said print head;

operator-controlled head gap adjusting means for manually operating said head advancing and retracting device, to thereby adjust said head gap; and adjusting mode selecting means for selecting one of an automatic adjusting mode in which said head gap is adjusted by said automatic head gap adjusting means, and a manual adjusting mode in which said head gap is adjusted by said operator-controlled head gap adjusting means.

2. A printing apparatus according to claim 1, wherein said operator-controlled head gap adjusting means is mechanically connected to said head advancing and retracting means, and comprises an operating lever which is manually operated to operate said head advancing and retracting means.

3. A printing apparatus according to claim 1, wherein said operator-controlled head gap adjusting means comprises operator-controlled switching means, and signal processing means connected to said switching means and said automatic head gap adjusting means and responsive to a signal generated by said switching means, for controlling said head advancing and retracting device.

4. A printing apparatus according to claim 1, further comprising position indicator means for indicating a position of said print head in said transverse direction.

5. A printing apparatus according to claim 4, wherein said position indicator means comprises a scale plate having graduations representative of the position of said print head, and a pointer movable relative to said scale plate in response to a movement of said print head in said transverse direction, to thereby cooperate with said graduations to indicate the position of the print head.

6. A printing apparatus according to claim 5, wherein said head advancing and retracting device comprises a stepping motor as a drive source, and an interval of said graduations of said scale plate is equal to a distance of movement of said pointer corresponding to an angle of rotation of said stepping motor which is obtained by one excitation cycle of the motor, said printing apparatus further comprising:

phase memory means for storing data representative of an excitation phase of said stepping motor when said pointer is aligned with one of said graduation of said scale plate; and hold-voltage applying means for applying a hold voltage to said stepping motor so as to establish said excitation phase stored in said phase memory means, when said manual adjusting mode is selected by said mode selecting means.

7. A printing apparatus according to claim 6, further comprising a positioning device for adjusting a position of said scale plate such that pointer points one of said graduations when said hold voltage is applied to said stepping motor, in said excitation phase stored in said phase memory means.

8. A printing apparatus according to claim 1, wherein said head advancing and retracting device comprises a drive source, a power transmission mechanism for transmitting a drive force of said drive source to said print head to move the print head in said transverse direction, and a clutch mechanism having a connecting state for transmitting said drive force of said drive source smaller than a preset value in a forward direction to advance the print head toward said platen, and a disconnecting state for inhibiting the transmission of said drive force exceeding said preset value to said print head, and wherein said automatic head gap adjusting means comprises clutch release detecting means for detecting said disconnecting state of said clutch mechanism, and stopping means for stopping an operation of said drive source that produces the drive force in said forward direction, when said disconnecting state of said clutch mechanism is detected by said clutch release detecting means.

9. A printing apparatus according to claim 8, wherein said clutch mechanism comprises:

a drive member operatively connected to said drive source;

a driven member operatively connected to said print head;

a first and a second engaging portion which are provided on said drive and driven members, respectively, and which engage each other such that a movement to retract said print head is transmitted from said drive member to said driven member while a movement to advance the print head is inhibited from being transmitted from the drive member to the driven member; and an elastic member having a predetermined pre-load biasing said first and second engaging portions of said drive and driven members for engagement of said first and second engaging portions with each other, said pre-load being smaller than said drive force of said drive source.

10. A printing apparatus comprising:

a platen for supporting a recording medium;

a print head disposed movably in a transverse direction toward and away from said platen;

a head advancing and retracting device for moving said print head in said transverse direction;

automatic head gap adjusting means for controlling said head advancing and retracting device to advance said print head until the print head comes into contact with said recording medium and then retracting the print head by a predetermined distance to adjust a head gap between said recording medium and said print head;

said head advancing and retracting device comprising a drive source, a power transmission mechanism for transmitting a drive force of said drive source to said print head to move the print head in said transverse direction, and a clutch mechanism having a connecting state for transmitting said drive force of said drive source smaller than a preset value in a forward direction to advance the print head toward said platen, and a disconnecting state for inhibiting the transmission of said drive force exceeding said preset value to said print head; and said automatic head gap adjusting means comprising clutch release detecting means for detecting said disconnecting state of said clutch mechanism, and stopping means for stopping an operation of said drive source that produces the drive force in said forward direction, when said disconnecting state of said clutch mechanism is detected by said clutch release detecting means.

11. A printing apparatus according to claim 10, wherein said clutch release detecting means comprises:

head stop detecting means for detecting that said print head is stopped in said transverse direction;

drive detecting means for detecting that said drive source is in operation; and clutch release determining means for determining that said clutch mechanism is placed in said disconnecting state, if said head stop detecting means detects that said print head is stopped, while said drive detecting means is detecting an operation of said drive source.

12. A printing apparatus according to claim 11, wherein said head stop detecting means comprises:

a sensor for generating an operation signal indicative of an operation of a sensed member of said power transmission mechanism which is disposed between said clutch mechanism and said print head; and stop determining means for generating said stop signal when said operation signal is absent.

13. A printing apparatus according to claim 12, wherein said drive source comprises a stepping motor, and said sensor comprises an encoder which produces a pulse signal in response to the operation of said sensed member of the power transmission mechanism, and wherein said drive detecting means comprises a motor detecting means for detecting each stepping operation of said stepping motor; and said clutch release determining means determines said disconnecting state when said motor detecting means has detected a predetermined number of stepping operations of said stepping motor while said pulse signals of said encoder are absent.

14. A printing apparatus according to claim 11, wherein said drive source comprises a stepping motor, and said drive detecting means comprises motor detecting means for detecting each stepping operation of said stepping motor.

15. A printing apparatus according to claim 11, wherein said head stop detecting means comprises:

an encoder for generating a basic pulse signal and a direction pulse signal having a relative phase difference, in response to an operation of a sensed member of said power transmission mechanism which is disposed between said clutch mechanism and said print head; and stop determining means for determining that said print head is moving in said transverse direction, only in a case where a level of said direction pulse signal upon one of successive rising and falling of said basic pulse signal is different from that of said direction pulse signal upon the other of said successive rising and falling of said basic pulse signal, said stop determining means determining that said print head is stopped in the other case.

16. A printing apparatus according to claim 15, wherein said drive source comprises a stepping motor, and said head stop detecting means comprises initial control means for activating said stop determining means after said stepping motor is operated a predetermined number of steps.

17. A printing apparatus according to claim 11, wherein said drive source comprises a stepping motor, and further comprising:

an encoder for generating a basic pulse signal and a direction pulse signal having a relative phase difference, in response to an operation of a sensed member of said power transmission mechanism which is disposed between said clutch mechanism and said print head; and out-of-synchronization determining means for determining that said stepping motor is placed in an out-of-synchronization state, if levels of said direction pulse signal upon rising and falling of said basic pulse signal are different from nominal levels which are determined by a direction in which said stepping motor is stepped.

18. A printing apparatus according to claim 12, wherein said sensor comprises an encoder which includes:

a movable slit member moved with said sensed member and including a slit portion having a multiplicity of slits equally spaced apart from each other, and a non-slit portion extending from one end of said slit portion;

a stationary basic slit member and a stationary direction slit member which are fixedly disposed adjacent to said movable slit member and have respective slits which have different positional phases relative to said slits of said slit portion of said movable slit member;

a first light-emitting element and a first light-receiving element which are disposed in facing relation with each other such that said movable slit member and said stationary basic slit member are positioned between said first light-emitting and light-receiving elements, said first light-receiving element generating a basic pulse signal; and a second light-emitting element and a second light-receiving element which are disposed in facing relation with each other such that said movable slit member and said stationary direction slit member are positioned between said second light-emitting and light-receiving elements, said second light-receiving element generating a direction pulse signal, said encoder having a reference position which is established based on a boundary position of said movable slit member in which a boundary between said slit portion and said non-slit portion of said movable slit member is aligned with said stationary basic slit member.

19. A printing apparatus according to claim 18, wherein said drive source comprises a stepping motor, and further comprising reference setting means for establishing said reference position of said encoder, such that said reference position is spaced from said boundary position by an amount corresponding to a predetermined number of stepping operations of said stepping motor, in a direction from said non-slit portion of said movable slit member toward said slit portion.

20. A printing apparatus according to claim 12, wherein said drive source comprises a stepping motor, and said sensor comprises an encoder which generates pulse signals in response to an operation of said sensed member of said power transmission mechanism, said printing apparatus further comprising:

reversing means for reversing a direction of operation of said stepping motor if no pulse signals are generated by said encoder during a predetermined number of stepping operations of said stepping motor in a reverse direction for retracting said print head away from said platen.

21. A printing apparatus according to claim 12, wherein said drive source comprises a stepping motor, and said sensor comprises an encoder which generates pulse signals in response to an operation of said sensed member of said power transmission mechanism, said printing apparatus further comprising:

alarm means for generating an error signal indicative of an abnormality of the apparatus, if no pulse signals are generated by said encoder while said stepping motor is stepped in a forward direction for advancing said print head toward said platen.

22. A printing apparatus according to claim 12, wherein said drive source comprises a stepping motor, said printing apparatus further comprising memory means for storing data representing an abutting position of said print head in which the print head abuts on said platen in the form of the number of stepping operations of said stepping motor in a forward direction for advancing the print head from an initial position corresponding to a predetermined reference position of said sensor, until said clutch release detecting means detects said disconnecting state of said clutch mechanism.

23. A printing apparatus according to claim 22, further comprising medium thickness determining means for calculating a thickness of said recording medium, by subtracting a content of said memory means when the recording medium is placed on said platen, from a content of said memory means when said recording medium is not placed on said platen.

24. A printing apparatus according to claim 23, further comprising means for changing said predetermined distance by which said print head is retracted by said head advancing and retracting device under the control of said automatic head gap adjusting means, depending upon the thickness of said recording medium calculated by said medium thickness determined means.

25. A printing apparatus according to claim 10, wherein said clutch mechanism comprises:

a drive member and a driven member;

a first and a second engaging portion which are provided on one and the other of said drive and driven members, respectively, and which engage each other such that a movement to retract said print head is transmitted from said drive member to said driven member while a movement to advance the print head is inhibited from being transmitted from the drive member to the driven member; and an electric member having a predetermined pre-load biasing said first and second engaging portions of said drive and driven members for engagement of said first and second engaging portions with each other, said pre-load being smaller than said drive force of said drive member.

26. A printing apparatus according to claim 25, wherein said drive and driven members are rotating members, and one of said first and second engaging portions consists of a pin which is secured to said one of said drive and driven members so as to extend parallel to axes of rotation said drive and driven members, while the other of said first and second engaging portions consists of a recess which is formed in said other of said drive and driven members so that said pin engages said recess with a play in a rotating direction of said other of the drive and driven members, said elastic member (44) biasing said pin against one of opposite ends of said recess in said rotating direction.

27. A printing apparatus according to claim 10, wherein said power transmission mechanism comprises an eccentric support shaft disposed parallel to said platen, a hollow guide sleeve, and a carriage slidably supported by said hollow guide sleeve and supporting said print head, said eccentric support shaft consisting of an intermediate portion and opposite end portions at which said eccentric support shaft is rotatably supported by a frame of the printing apparatus, said intermediate and eccentric portions being eccentric with each other, and said hollow guide sleeve being disposed radially outwardly of and coaxially with said intermediate portion such that said hollow guide sleeve and said eccentric support shafts are rotatable relative to each other, said drive force of said drive source rotating said eccentric support shaft.

28. A method of adjusting a head gap in a printing apparatus, said apparatus comprising a platen for supporting a recording medium;

a print head disposed movably in a transverse direction toward and away from said platen;

a head advancing and retracting device for moving said print head in said transverse direction;

automatic head gap adjusting means for controlling said head advancing and retracting device to advance said print head until the print head comes into contact with said recording medium and then retracting the print head by a predetermined distance to adjust a head gap between said recording medium and said print head;

said head advancing and retracting device comprising a drive source, a power transmission mechanism for transmitting a drive force of said drive source to said print head to move the print head in said transverse direction, and a clutch mechanism having a connecting state for transmitting said drive force of said drive force smaller than a preset value in a forward direction to advance the print head toward said platen, and a disconnecting state for inhibiting the transmission of said drive force exceeding said preset value to said print head; and said automatic head gap adjusting means comprising clutch release detecting means for detecting said disconnecting state of said clutch mechanism, and stopping means for stopping an operation of said drive source that produces the drive force in said forward direction, when said disconnecting state of said clutch mechanism is detected by said clutch release detecting means, comprising the steps of:

positioning said print head at a predetermined position which is spaced from said platen by a known distance;

operating said automatic head gap adjusting means to advance said print head until the print head comes into contact with said platen, with no recording medium placed on said platen, and determining a first advancing distance of said print head between said predetermined position and a position at which the print head contacts said platen;

calculating a difference between said known distance and said first advancing distance, as a specific value inherent to the printing apparatus;

retracting said print head and placing the recording medium on said platen;

operating said automatic head gap adjusting means again to advance said print head, until the print head comes into contact with the recording medium placed on said platen; and retracting said print head by a distance equal to a sum of said specific value and a nominal head gap value.

29. A method of adjusting a head gap in a printing apparatus having a platen for supporting a recording medium, (b) a print head disposed movably in a transverse direction toward and away from said platen, (c) a head advancing and retracting device for moving said print head in said transverse direction, and (d) automatic head gap adjusting means for controlling said head advancing and retracting device to advance said print head until the print head comes into contact with said recording medium and then retracting the print head by a suitable distance, to thereby adjust said head gap between said recording medium and said print head, said method comprising the steps of:

positioning said print head at a predetermined position which is spaced from said platen by a known distance;

operating said automatic head gap adjusting means to advance said print head until the print head comes into contact with said platen, with no recording medium placed on said platen, and determining a first advancing distance of said print head between said predetermined position and a position at which the print head contacts said platen;

calculating a difference between said known distance and said first advancing distance, as a specific value inherent to the printing apparatus;

retracting said print head and placing the recording medium on said platen;

operating said automatic head gap adjusting means again to advance said print head, until the print head comes into contact with the recording medium placed on said platen; and retracting said print head by a distance equal to a sum of said specific value and a nominal head gap value, said sum consisting of said suitable distance.

30. A printing apparatus comprising:

a platen for supporting a recording medium;

a print head disposed movably in a transverse direction toward and away from said platen;

a head advancing and retracting device for moving said print head in said transverse direction;

said head advancing and retracting device comprising a drive source, a power transmission mechanism for transmitting a drive force of said drive source to said print head to move the print head in said transverse direction, and a clutch mechanism having a connecting state for transmitting said drive force of said drive source smaller than a preset value in a forward direction to advance the print head toward said platen, and a disconnecting state for inhibiting the transmission of said drive force exceeding said preset value to said print head; and said clutch mechanism comprising a drive member, a driven member, a first and a second engaging portion which are provided on one and the other of said drive and driven members, respectively, and an elastic member, said first and second engaging portions engaging each other such that a movement to retract said print head is transmitted from said drive member to said driven member while a movement to advance the print head is inhibited from being transmitted from the drive member to the driven member, said elastic member having a predetermined pre-load biasing said first and second engaging portions of said drive and driven members for engagement of said first and second engaging portions with each other, said pre-load being smaller than said drive force of said drive member.

31. A printing apparatus according to claim 30 wherein said drive and drive members are rotating members, and one of said first and second engaging portions consists of a pin which is secured to said one of said drive and driven members so as to extend parallel to axes of rotation of said drive and driven members, while the other of said first and second engaging portions consists of a recess which is formed in said other of said drive and driven members so that said pin engages said recess with a play in a rotating direction of said other of the drive and driven members, said elastic member biasing said pin against one of opposite ends of said recess in said rotating direction.

* * * * *